US006908342B2

(12) United States Patent
Shimada

(10) Patent No.: US 6,908,342 B2
(45) Date of Patent: Jun. 21, 2005

(54) CONNECTOR, ELECTRONIC EQUIPMENT USING THE CONNECTOR AND INFORMATION PROCESSING UNIT

(75) Inventor: Tsutomu Shimada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/254,650

(22) Filed: Sep. 26, 2002

(65) Prior Publication Data

US 2003/0073350 A1 Apr. 17, 2003

(30) Foreign Application Priority Data

Oct. 2, 2001 (JP) ..... 2001/306537
Oct. 24, 2001 (JP) ..... 2001/326363
Nov. 29, 2001 (JP) ..... 2001/364308

(51) Int. Cl.[7] ..... H01R 13/44; H01R 24/00
(52) U.S. Cl. ..... 439/630; 439/136; 439/141
(58) Field of Search ..... 439/630, 59, 64, 439/136–141

(56) References Cited

U.S. PATENT DOCUMENTS 4,780,793 A * 10/1988 Ohtsuki ..... 361/756
5,580,268 A * 12/1996 Miyazawa ..... 439/352
6,109,940 A * 8/2000 Chao et al. ..... 439/141
6,139,338 A * 10/2000 Hirai et al. ..... 439/141
6,328,588 B1 12/2001 Tsai et al. ..... 439/352
6,413,108 B2 * 7/2002 Centofante ..... 439/267

FOREIGN PATENT DOCUMENTS

| | | |
|---|---|---|
| JP | 1-91579 | 6/1988 |
| JP | 6-139415 | 5/1994 |
| JP | 2001-43339 | 2/2001 |

* cited by examiner

*Primary Examiner*—Michael C. Zarroli
(74) *Attorney, Agent, or Firm*—Fitzpatrick, Cella, Harper & Scinto

(57) ABSTRACT

Electronic equipment attachable to and removable from a main frame apparatus includes a container and a connector. Guides are formed on both sides of the connector, and aperture portions are provided in these guides such that parts of shutter lock portions are exposed. The lock portions can move between a lock position and a lock releasing position. In the lock position a shutter protects a connection portion of the connector, and in a lock releasing position, the shutter is maintained in a movable state.

20 Claims, 41 Drawing Sheets

CONNECTOR, ELECTRONIC EQUIPMENT USING THE CONNECTOR AND INFORMATION PROCESSING UNIT

BACKGROUND OF THE INVENTION

1. Field of the Invention

The present invention relates to connectors, electronic equipment, and information processing units, and more particularly to a connector installed on electronic equipment, the electronic equipment incorporating electronic components, for example, a storage medium such as a hard disk or a semiconductor memory, and attachable to and removable from a main apparatus such as a personal computer, and an information processing unit.

2. Description of the Related Art

A portable notebook-sized personal computer has been brought into practical use by small sizing and high performance formation of components.

Further, there have currently increased the number of people who own a desktop personal computer and the notebook-sized personal computer in an office, and a plurality of personal computers in homes. For that reason, there have occurred needs for intended to manage unitarily data stored in a hard disk in the personal computer, or for intended to carry data having a large capacity.

Furthermore, since a digital camera and a digital video camera have been used widely, data amounts of digital data have increased considerably, and there has occurred a problem that a storage capacity of the hard disk is liable to be filled with data immediately.

Meanwhile, the storage capacity of a hard disk has been rapidly increased every year, so that there has increased needs for intending to exchange an old hard disk having small storage capacity to a new hard disk having large storage capacity.

In order to meet these needs, there has been proposed a removable hard disk to be easily portable and easily exchangeable.

However, when the removable hard disk is removed from such as the personal computer, since a user manually performs attaching and removing the hard disk to/from the personal computer, if for some reason the hard disk should be detached from the personal computer during access, which might lead to such a possibility that data in the hard disk have been broken and the entire important data have been disappeared.

In addition, there is a request that the removable hard disk is automatically removed from such as the personal computer similar to that of a VTR cassette tape.

Consequently, in order to solve these problems and request, there has been proposed a mechanism (auto-loading mechanism) for automatically removing the removable hard disk by only pushing a switch.

However, in a removable hard disk apparatus, since there is exposed a connector portion for electrically connecting to a main frame apparatus such as the personal computer, there has been a concern that adhesion of dust and static electricity exert an adverse effect on data in a hard disk.

For that reason, although consideration is made on constitution for covering the connector portion by a shutter, in anyway, a method for realizing the auto-loading mechanism with simple constitution has been expected.

Further, it has been desired that a shutter be constituted so that it never opens unintentionally.

SUMMARY OF THE INVENTION

It is an object of the present invention to realize a shutter for covering a connection portion of a connector with simple constitution.

Further, it is another object of the present invention to realize an auto-loading mechanism with simple constitution.

An electronic equipment of the present invention includes a container incorporating electronic components, and a connector electrically connected to the electronic components and arranged in a side portion of the container, and the electronic equipment is characterized by comprising:

a protective portion movable between a first position and a second position in order to protect the connectors; and lock portions for fixing the protective portion at the first position, wherein the connector is connected to an exterior connector, whereby the lock portions are released, and the protective portion can be movable between the first position and the second position.

Further, an information processing unit of the present invention is the information processing unit constructed of an electronic equipment incorporating electronic components, and a main body to which the electronic equipment is connected, the electronic equipment comprising:

a first connector arranged on a side portion of a container electrically connected to the electronic components;

a protective portion movable between a first position and a second position, in order to protect the first connector; and lock portions for fixing the protective portion to the first position, the main body comprising a second connector connecting the first connector, wherein the lock portions are released by connecting the first connector to the second connector, and the protective portion becomes movable between the first position and the second position.

Furthermore, a connector of the present invention is the connector constructed of a first connector and a second connector which are attachable to and removable from each other, the first connector portion comprising:

a first connection portion electrically connected to the second connector portion;

a protective portion movable between a first position and a second position in order to protect the first connection portion;

guide portions provided on both sides of the first connector; and lock portions for locking the protective portion to the first position, the second connector comprising:

a second connection portion for connecting to the first connection portion;

a first member for moving the protective portion from the first position to the second position; and a second member for releasing the lock portions.

In addition, an auto-loading apparatus of the present invention comprising:

an electronic equipment including a container incorporating electronic components, and a first connector electrically connected to the electronic components and arranged in a side portion of the container and attachable to and removable from a main body apparatus;

a second connector for electrically connecting to the first connector;

a connection means, one side thereof being electrically connected to the second connector, the other side thereof being connected to the electronic equipment on a main body side;

a first chassis in which, the electronic equipment is movable between a first position not connecting the first connector to the second connector, and a second position connecting the first connector to the second connector, and guide members are provided for guiding the first connector to the second connector;

a second chassis for guiding the first chassis; and a moving means for moving the first chassis.

Moreover, an auto-loading apparatus of the present invention comprising:

a first chassis for holding a removable electronic equipment having a first connector;

a second chassis for holding the first chassis, and the first chassis being movable between a first position and a second position;

a second connector provided in the first chassis, and electrically connected to a first connector of the electronic equipment; and a moving means for moving the first chassis between the first position and the second position.

DETAILED DESCRIPTION OF THE PREFERRED EMBODIMENT

Hereinafter, a first embodiment of the present invention will be described in detail with reference to the drawings.

First Embodiment

Figure 1A:
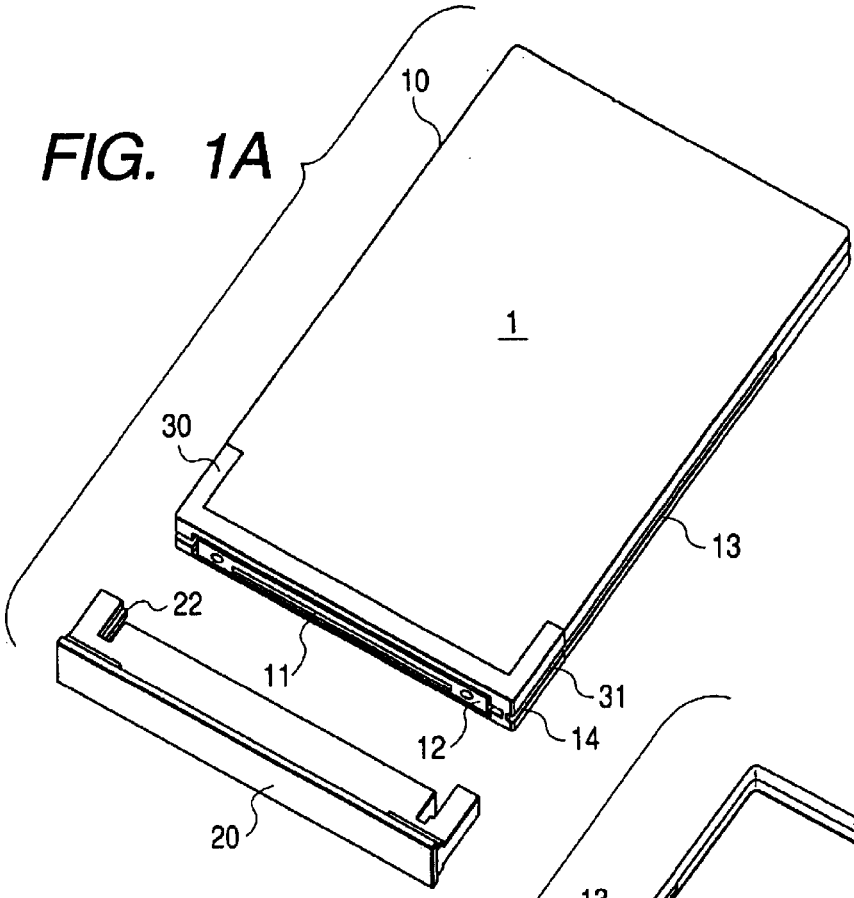
FIGS. 1A and 1B are perspective views of an electronic equipment and connectors according to the present embodiments.
Figure 1B:
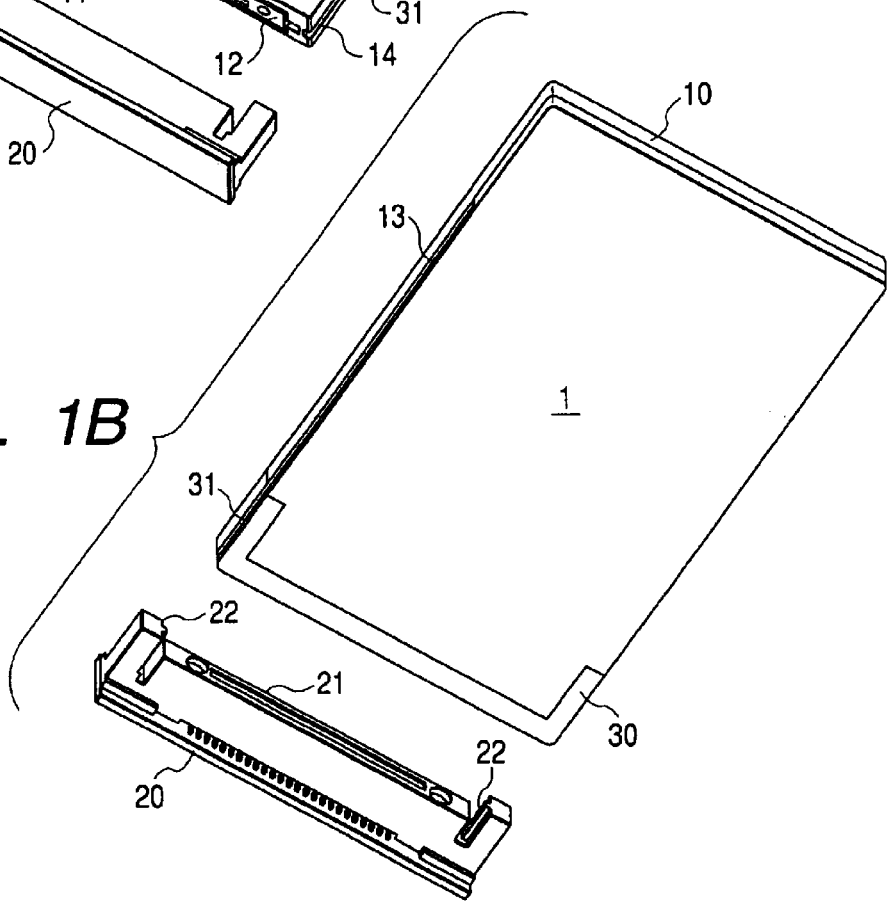

FIGS. 1A and 1B are perspective view of an electronic equipment and connectors according to the present embodiments.

In figure, FIGS. 1A and 1B show the electronic equipment and the connectors viewed, from directions different from each other.

In figure, numeral 1 denotes an electronic equipment and it is constituted of a container 10 and a connector 30, and a storage medium such as a hard disk and a semiconductor memory and electronic components for driving (reading and writing data) the storage medium are incorporated in inside of the container 10. The connector 30 is freely attached to and removed from the container 10, and is fixed to the container 10 by screws, vises, and a solder in a state installed on the container 10.

Numeral 20 denotes a connector, the connector 20 is fixed to an information processing unit main body such as a personal computer, and the information processing unit main body transmits and receives data between it and the electronic equipment 1 by connecting the connector 20 to the connector 30.

Recessed-shaped guides 31 are provided on both sides of the connector 30, and the guides 31 are continuously linked to guides 13 provided on both sides of the container 10.

The guides 31 and 13 are those for being supported by guide receiving portions provided at both ends of an installation portion of the information processing unit main body, and the installation portion is used for installing the electronic equipment 1.

A connection portion 11 of the connector 30 is constituted to be covered by a shutter 12, and the connection portion 11 and a connection portion 21 are constituted to be connected after the shutter 12 is pushed by the connection of the connector 20 to the connector 30.

Figure 2:
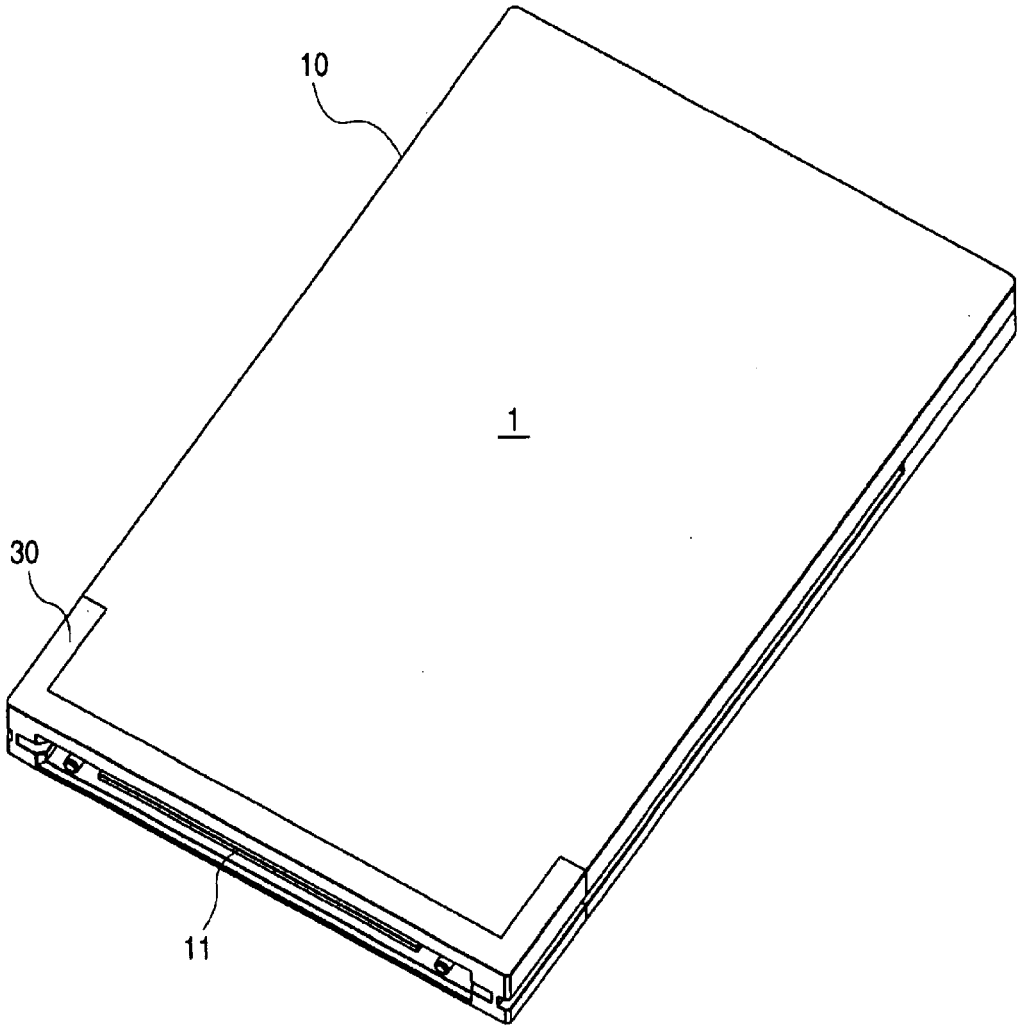
FIG. 2 is a perspective view showing a state where a shutter 12 is pushed (opened), in a state of having connected a connector 20 to a connector 30.

FIG. 2 is a perspective view showing a state where the shutter 12 is pushed (opened) by the connector 20, in a state of connecting the connector 30 to the connector 20. Meanwhile, the connector 20 is not shown.

Figure 3:
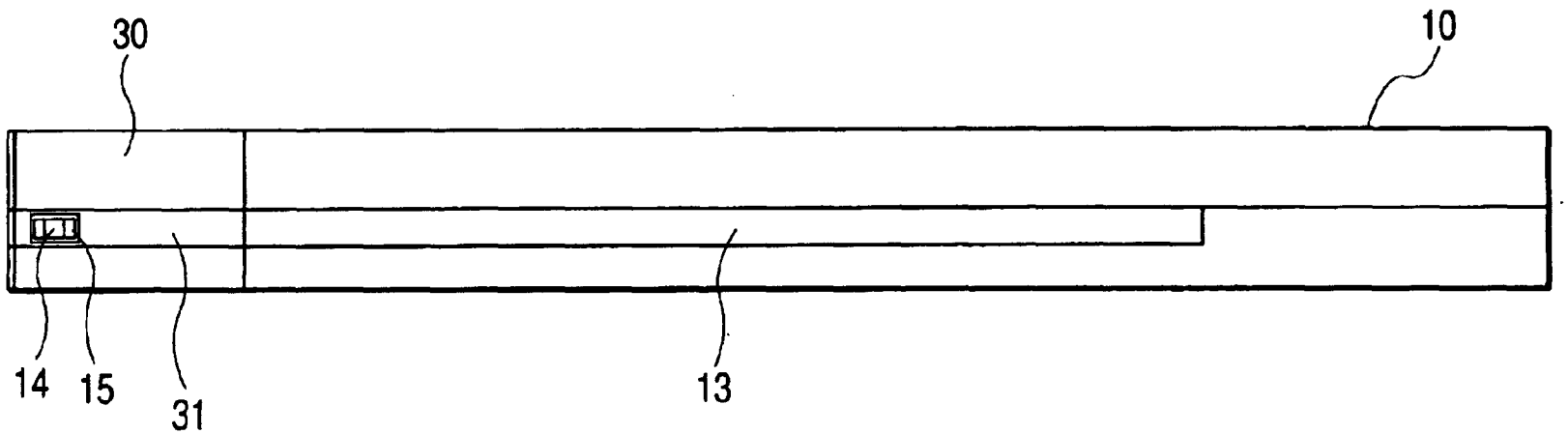
FIG. 3 is a side view of an electronic equipment 1.

FIG. 3 is a side view of the electronic equipment 1.

As shown in FIGS. 1A, 1B, and 3, parts of lock portions 14 for locking the shutter 12 are exposed to outsides from aperture portions 15 of the guide portions 31 of the connector 30.

The lock portions 14 are constituted by such a structure that in connecting the connector 30 to the connector 20, locking is released when the lock portions 14 are pushed by lock-releasing portions 22 of the connector 20, and the shutter 12 opens.

Further detailed explanation will be tried regarding the lock portions 14.

Figure 4A:
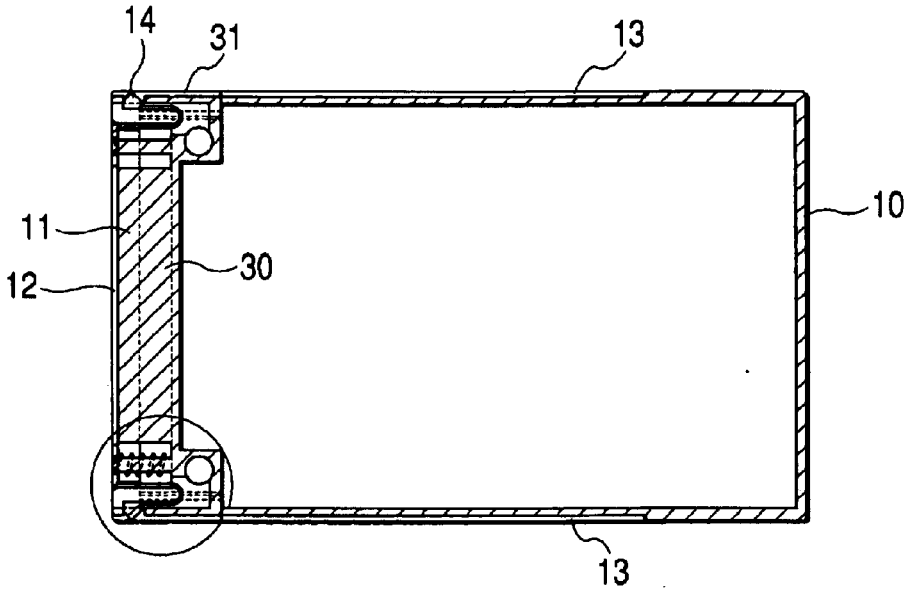
FIGS. 4A and 4B are sectional views of an electronic equipment 1 in a state where a shutter 12 is locked by lock portions 14.
Figure 4B:
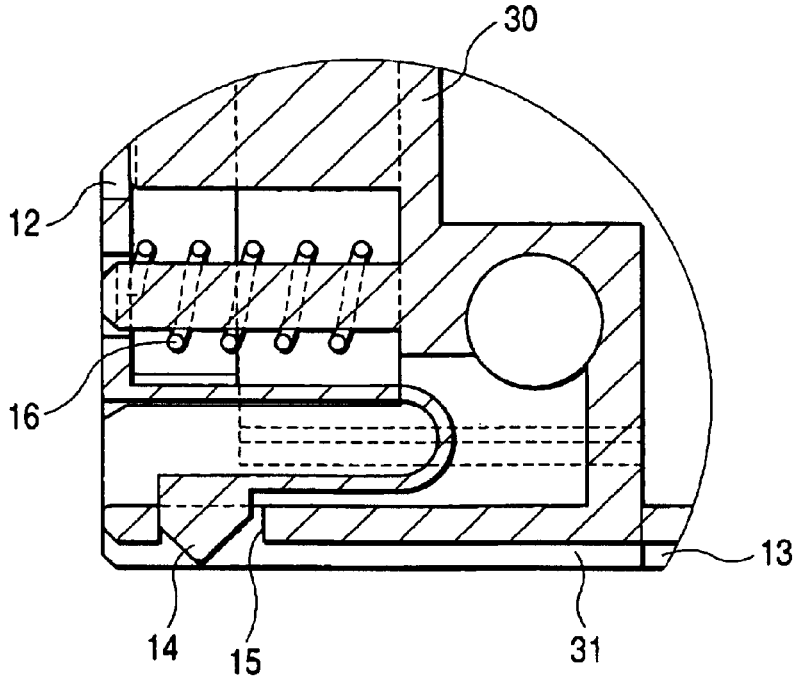
Figure 5A:
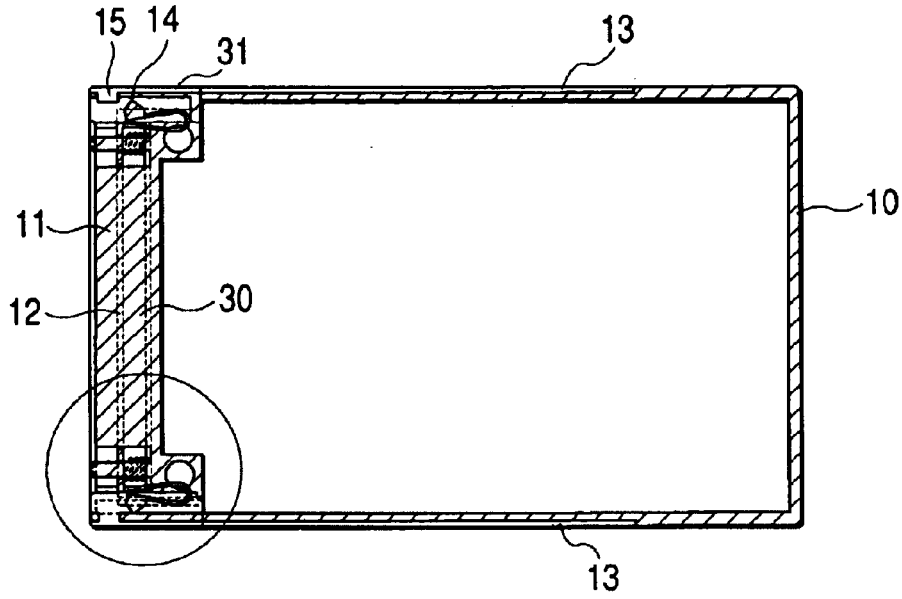
FIGS. 5A and 5B are sectional views of an electronic equipment 1 in states where lock portions 14 are released by lock releasing portions 22 or a connector 20, and where a shutter 12 is opened.
Figure 5B:
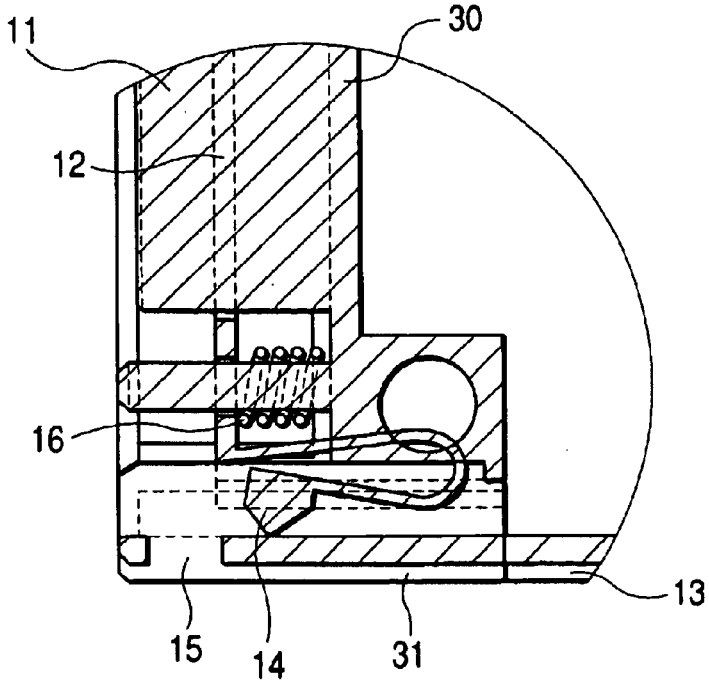

FIGS. 4A, 4B, 5A, and 5B are sectional views of the electronic equipment 1. FIGS. 4A and 4B show a state where the shutter 12 is locked by the lock portions 14. FIGS. 5A and 5B show a state where the lock portions 14 are released by the lock-releasing portions 22 of the connector 20, and the shutter is opened.

In a locking state, the shutter 12 is constituted to be in a closed state by springs 16.

When the connector 20 is connected to the connector 30, the lock portions 14 are pushed to insides by the lock-releasing portions 22, and locking is released. Then, the shutter 12 is pushed by a projection portion on the periphery of the connection portion 21 of the connector 20, the connection portion 11 is connected to the connection portion 21, the electronic equipment 1 is electrically connected to the information processing unit main body, and information can be transmitted and received between an information processing unit and the electronic equipment 1.

Meanwhile, in the present embodiment, when the electronic equipment 1 is installed on the information processing unit main body and the guide portions 13 and 31 are supported by the guide receiving portions of the information processing unit main body, although the lock portions 14 are slightly pushed by the guide receiving portions, the lock portions 14 are constituted such that the lock portions 14 are not pushed until a state where locking is completely detached.

When the connector 30 is removed from the connector 20 (when electronic equipment 1 is removed from information processing unit main body), as the connection portion 11 and the connection portion 21 are separated from each other, the shutter 12 having been pushed by the projection portion on the periphery of the connection portion 21 is returned by the force of the springs 16, whereby, parts of the lock portions 14 are exposed from the aperture portions 15, parts of the shutter 12 are exposed from the aperture portions 15 by a spring action of the shutter 12 itself, whereby the shutter 12 is brought into a state to be locked.

As described above, according to the present embodiment, a protection of a connector portion can be realized with a simple constitution.

Further, locking for protecting the connector portion can be realized with a simple constitution.

Furthermore, since a protective mechanism having a simple constitution is realized by using two kinds of springs, in addition to that, a lock mechanism is realized by providing aperture portions for the lock mechanism in the guide portions, a structure of the connector becomes simplified.

Second Embodiment

Next, a second embodiment of a lock mechanism of a shutter portion will be described.

Figure 6:
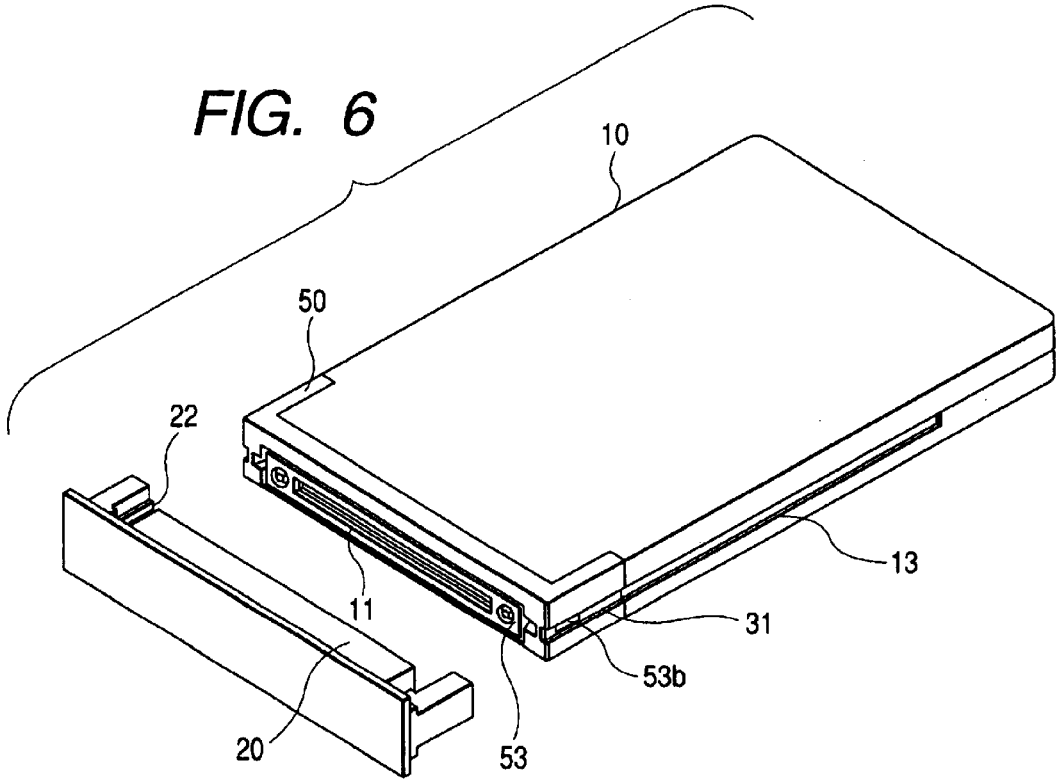
FIG. 6 is a perspective view of an electronic equipment and connectors according to a second embodiment.

FIG. 6 is a perspective view of an electronic equipment and a connector according to the second embodiment. Meanwhile, portions of a connector 20 and a container 10 are similar to that of the first embodiment.

Figure 7A:
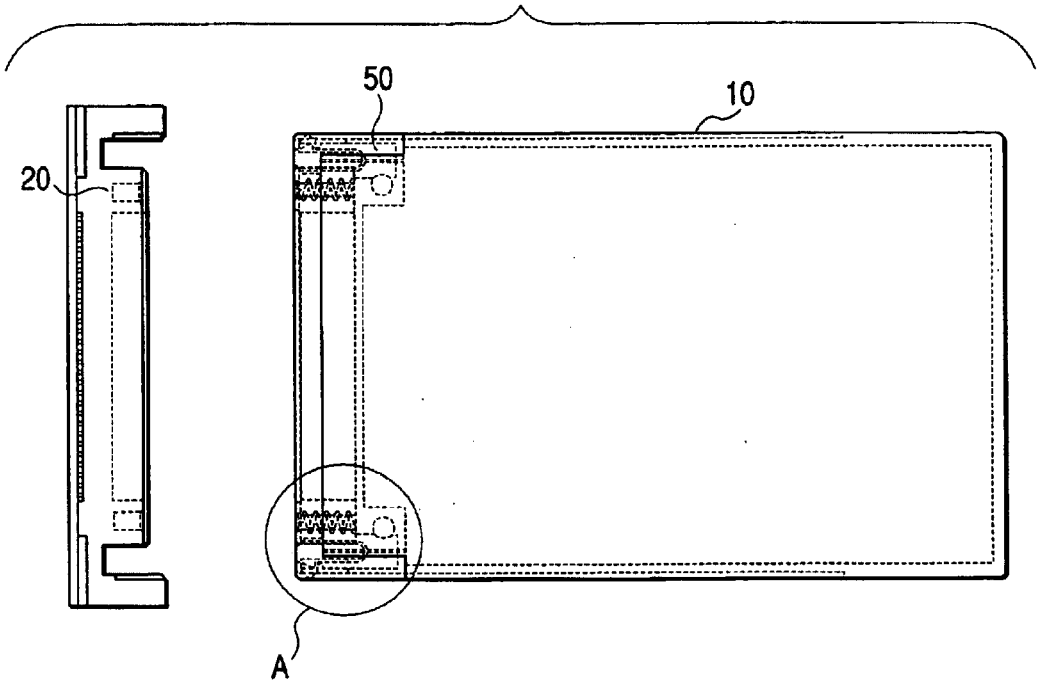
FIGS. 7A and 7B are plan views viewed, from above, an electronic equipment according to a second embodiment.
Figure 7B:
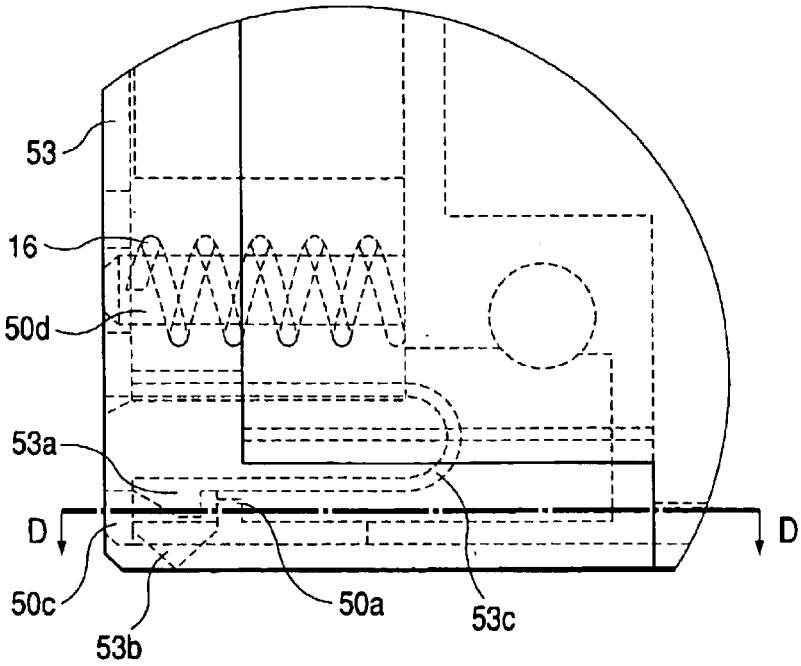
Figure 8:
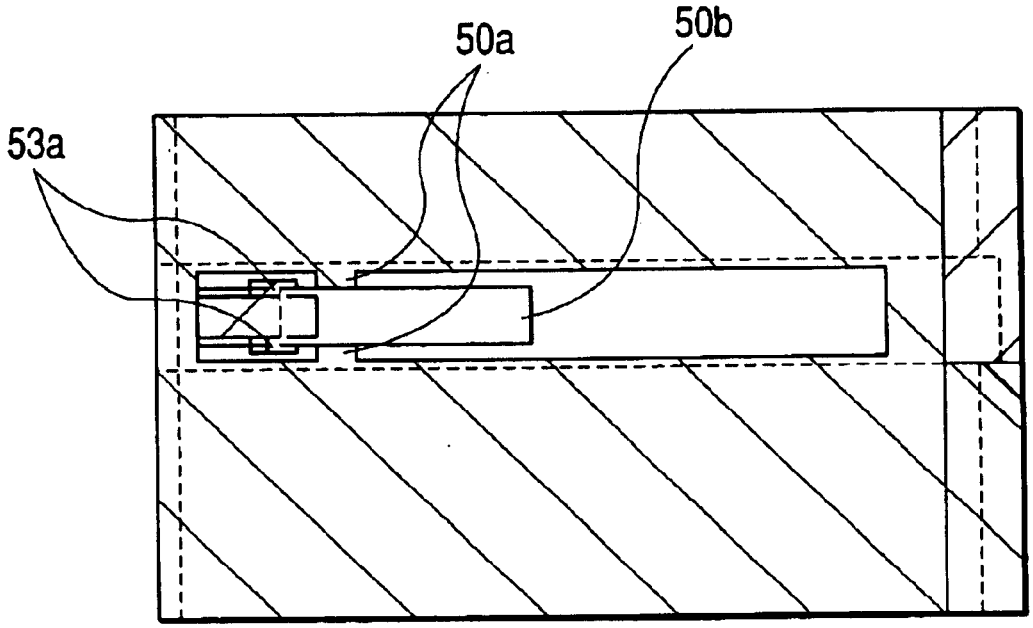
FIG. 8 is a sectional view taken on line D—D in FIG. 7B, FIGS. 9A and 9B are side views viewed, from a right side, an electronic equipment according to a second embodiment.

FIG. 7A is a plan view viewed (partially drawn in perspective), from above, the electronic equipment according to the second embodiment, FIG. 7B is an enlarged view of an A portion (partially drawn in perspective) in FIG. 7A, and FIG. 8 is a sectional view taken on line D—D in FIG. 7B.

A connector 50 fitted with the connector 20 is provided in the container 10, and a connection portion 11 of the connector 50 is covered by a shutter 53. The shutter 53 is constituted such that the shutter 53 is pushed in a left direction (in direction concealing connection portion) in FIGS. 7A and 7B, by springs 16 inserted into shafts 50*d* integrally installed with the connector 50, and the shutter 53 is not detached from inside of an connector 50 by stoppers 50*c*. The shutter 53 is made of resin, spring portions 53*c* are integrally installed with the shutter 53 on both sides thereof, and projection portions 53*b* are provided at tip portions of the spring portions 53*c*. In addition, claw portions 53*a* are formed on above and below in a thickness direction of the projection portions 53*b*.

As shown in FIG. 8, aperture portions 50*b* are provided in grooves 31 of both sides of the connector 50 so that the projection portions 53*b* can move laterally as shown in FIG. 8. Lock portions 50*a* are formed in parts of in above and below directions of the aperture portions 50*b*, and are constituted in such a positional relationship that in a free state of the spring portions 53*c*, the lock portions 50*a* are interfered with the claw portions 53*a*.

Next, the lock mechanism of the shutter 53 will be described in more detail.

Figure 9A:
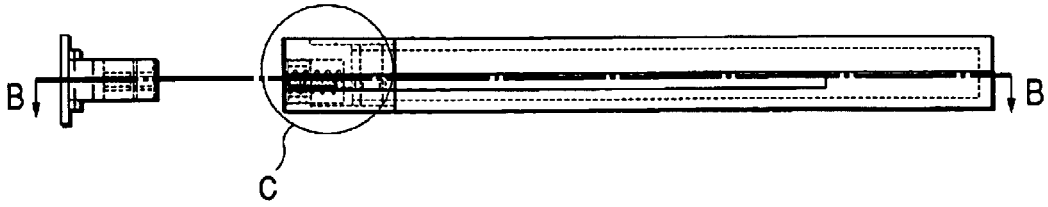
Figure 9B:
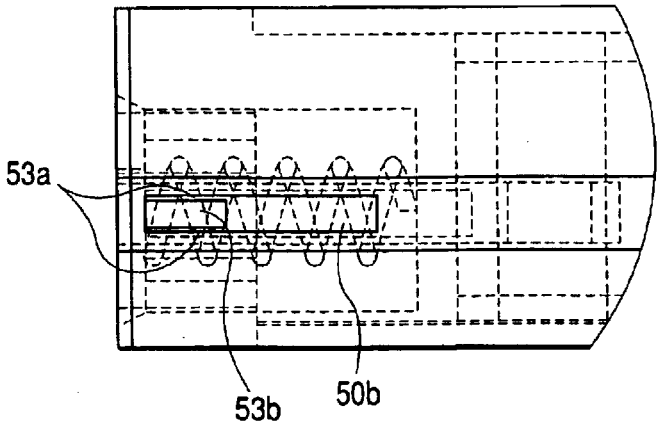
Figure 10A:
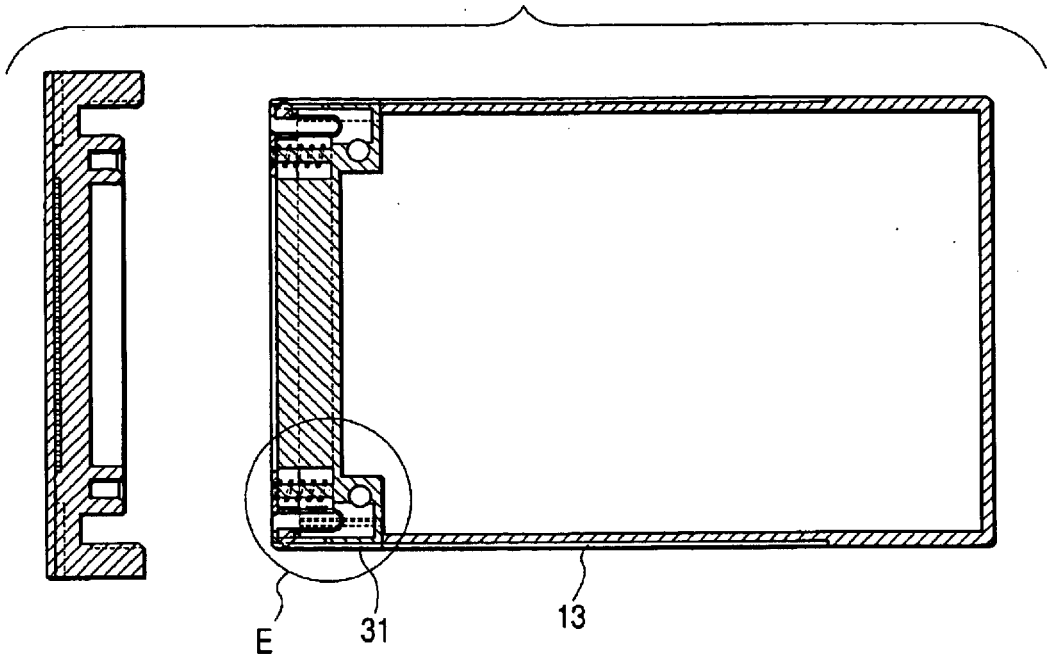
FIGS. 10A and 10B are sectional views taken on line B—B in FIG. 9A, FIGS. 11A and 11B are sectional views displaying lock release mechanism portions in a second embodiment.

FIG. 9A is a side view viewed, from right side, the electronic equipment according to the second embodiment, and FIG. 9B is an enlarged view of a C portion in FIG. 9A. FIG. 10A is a sectional view taken on line B—B in FIG. 9A, and FIG. 10B is an enlarged view of an E portion in FIG. 10A.

Figure 10B:
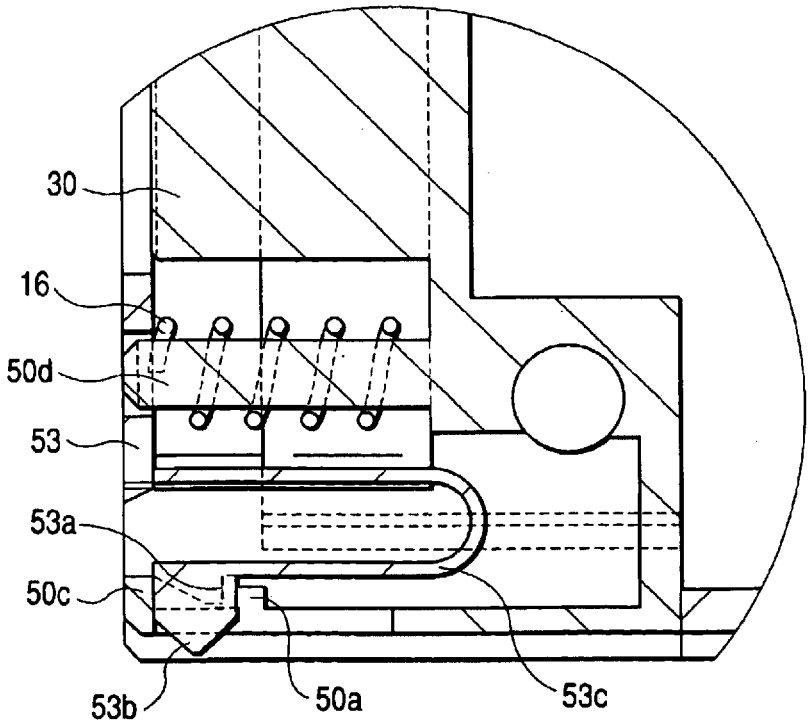

As shown in FIGS. 9B and 10B, in a state where the connector 20 is not fitted with the connector 50, since the projection portions 53*b* of the tip portions of the spring portions 53*c* are not pushed, even if the shutter 53 should be pushed in a right direction (in direction exposing connection portion) in FIG. 10A, the claw portions 53*a* are caught by the lock portions 50*a* of the connector 50, and the shutter 53 cannot move in a right direction.

Next, a case where the lock mechanism is released will be described.

Figure 11A:
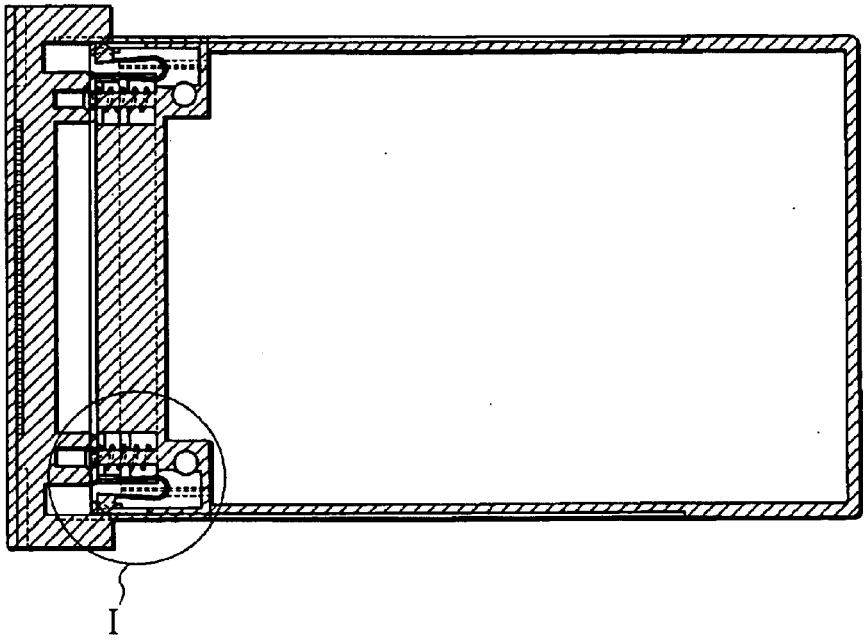
Figure 11B:
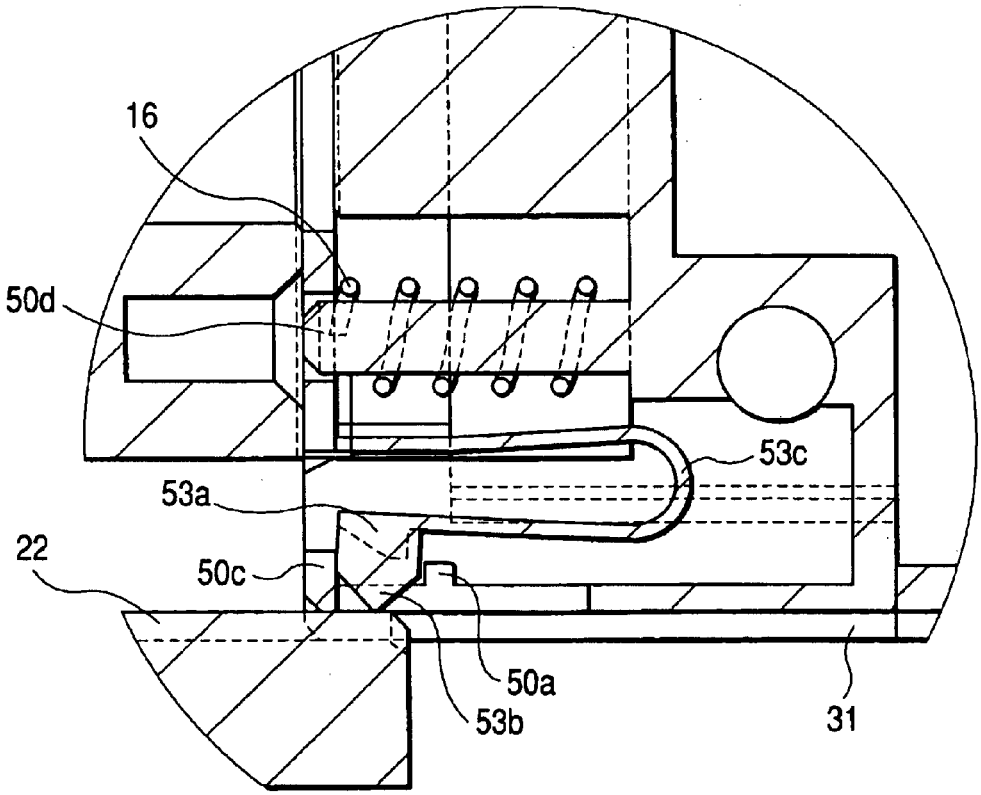
Figure 12A:
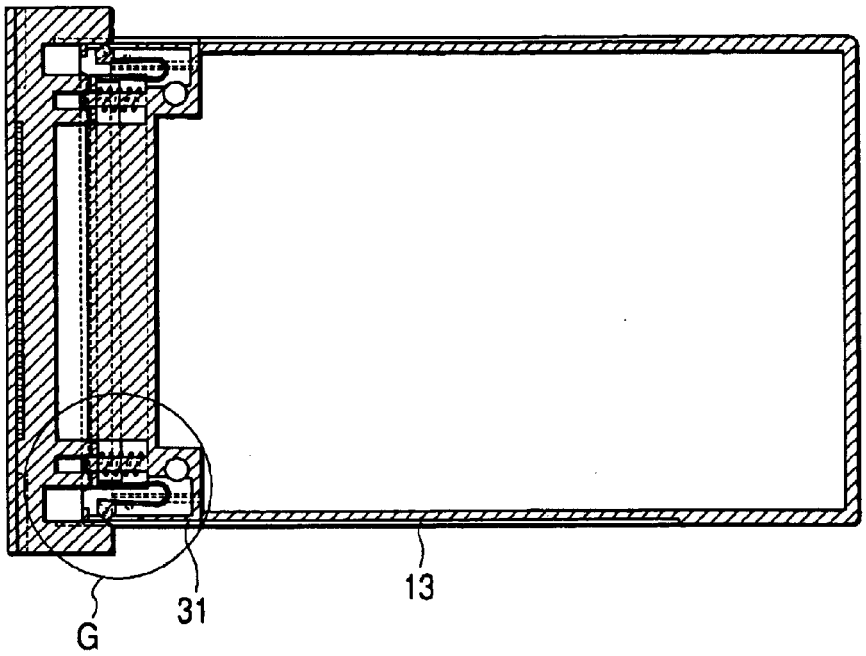
FIGS. 12A and 12B are sectional views displaying lock release mechanism portions in a second embodiment.
Figure 12B:
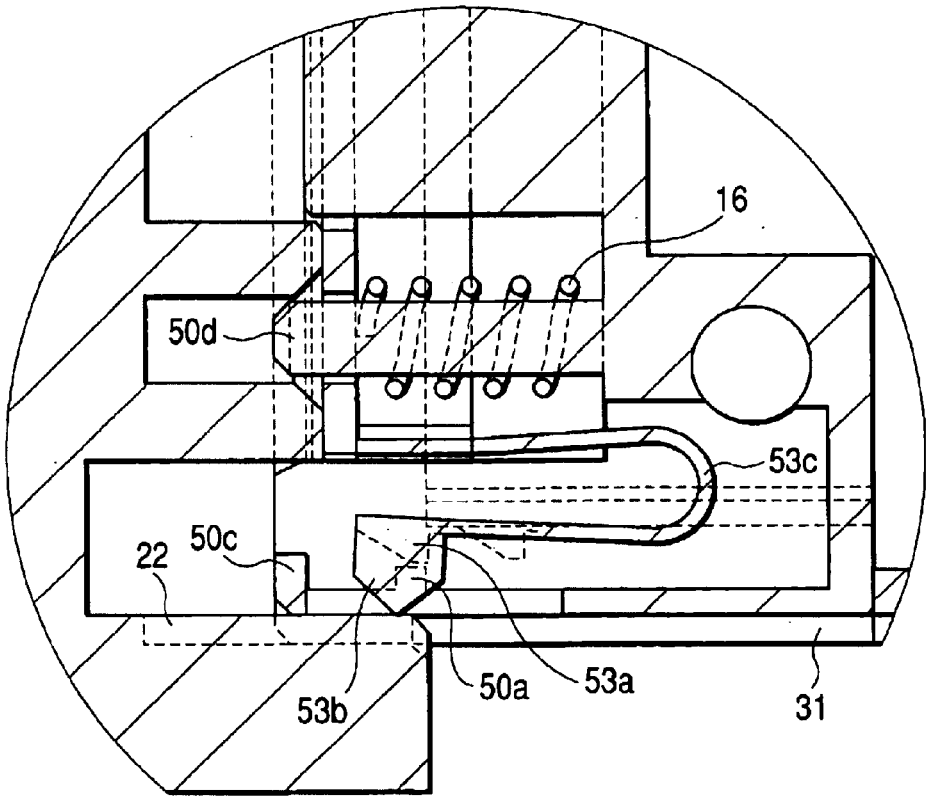
Figure 13A:
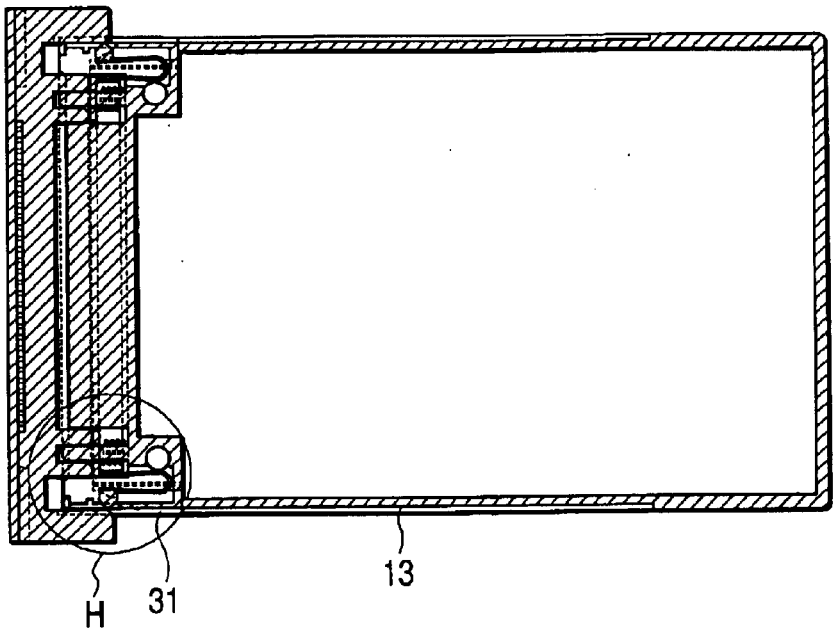
FIGS. 13A and 13B are sectional views displaying lock release mechanism portions in a second embodiment.

FIG. 11A is a sectional view showing a state where tips of the lock releasing portions 22 of the connector 20 are inserted into the grooves 31 and the projection portions 53*b* are pushed inside of the connector 50. FIG. 11B is an enlarged view of an I portion in FIG. 11A. FIG. 12A displays a state where the connector 20 is further inserted into the connector 50. FIG. 12B is an enlarged view of a G portion in FIG. 12A. FIG. 13A displays a state where the connector 20 is completely inserted into the connector 50, and FIG. 13B is an enlarged view of an H portion in FIG. 13A.

Figure 13B:
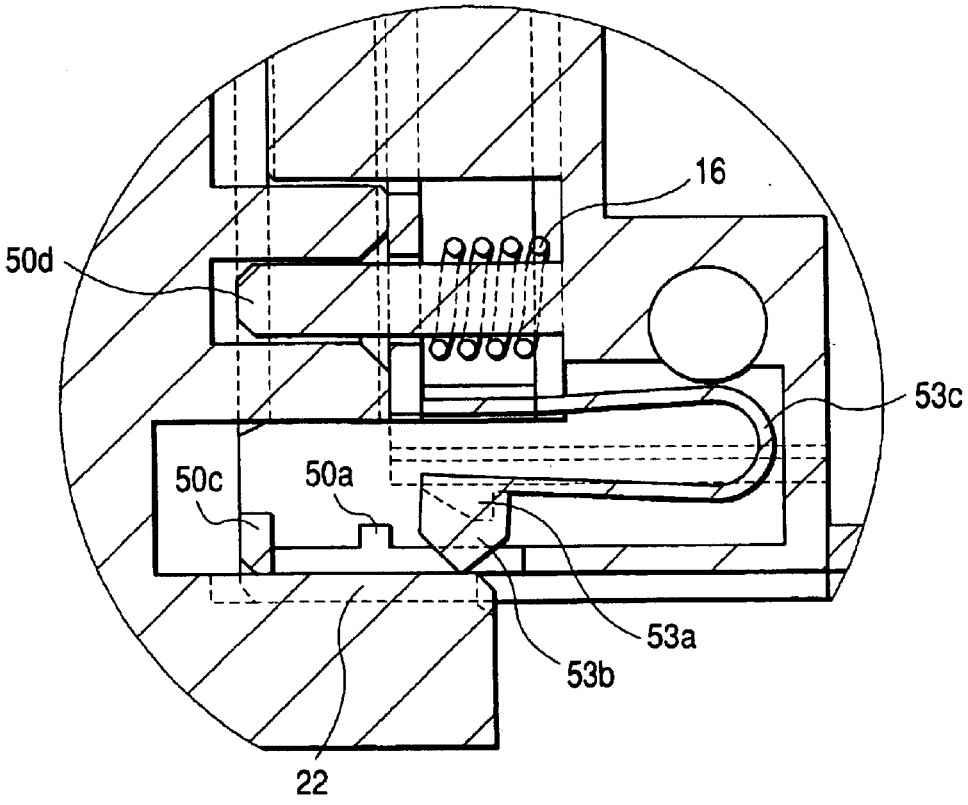

As displayed in FIGS. 11B, 12B, and 13B, when the connector 20 is inserted into the connector 50, the lock releasing portions 22 push the projection portion 53*b* to inside of the connector, whereby the spring portions 53*c* are deformed, the projection portions 53*b* are moved to the inside, and the integrally formed claw portions 53*a* are moved also to the inside. As is displayed in FIG. 12B, since the claw portions 53*a* do not interfere with the lock portions 50*a* in this state, the shutter 53 moves in a right direction due to an insertion of the connector 20 into the connector 50, and the connector 20 and the connector 50 are completely coupled to each other.

A case where the connector 20 is detached from the connector 50 is similar to the above-described. When the connectors are in a state to be inserted to each other, each of the lock releasing portions 22 move the projection portion 53*b* to an inside, since the claw portions 53*a* do not interfere with the lock portions 50*a*, the shutter 53 is pushed by the springs 16, and moves together with the connector 20, and stops after the projection portion 53*b* are collided with the stoppers 50*c*.

As described above, there are provided the aperture portions 50*b* for moving the projection portions 53*b* which are pushed by the lock releasing portions 22 in order to release locking of the shutter 53, and a mechanism for locking the shutter 53 is provided in another location, which lead to a decrease in deformation of the spring portions 53*c*, therefore the possibility of a generation of creep caused by the deformation is decreased. In addition, the projection portions 53*b* are not brought into contact with an inner wall of the connector 50, which leads to a decrease in a sliding load and can prevent abrasion of the inner wall.

Third Embodiment

In the first and also the second embodiment, an example where a shutter portion and lock portions being integrally formed with each other is described, however, as shown below, consideration can be made to constitute the shutter portion by a member separate from the lock portions. Hereinafter, the details thereof will be described with reference to the drawings.

Figure 14A:
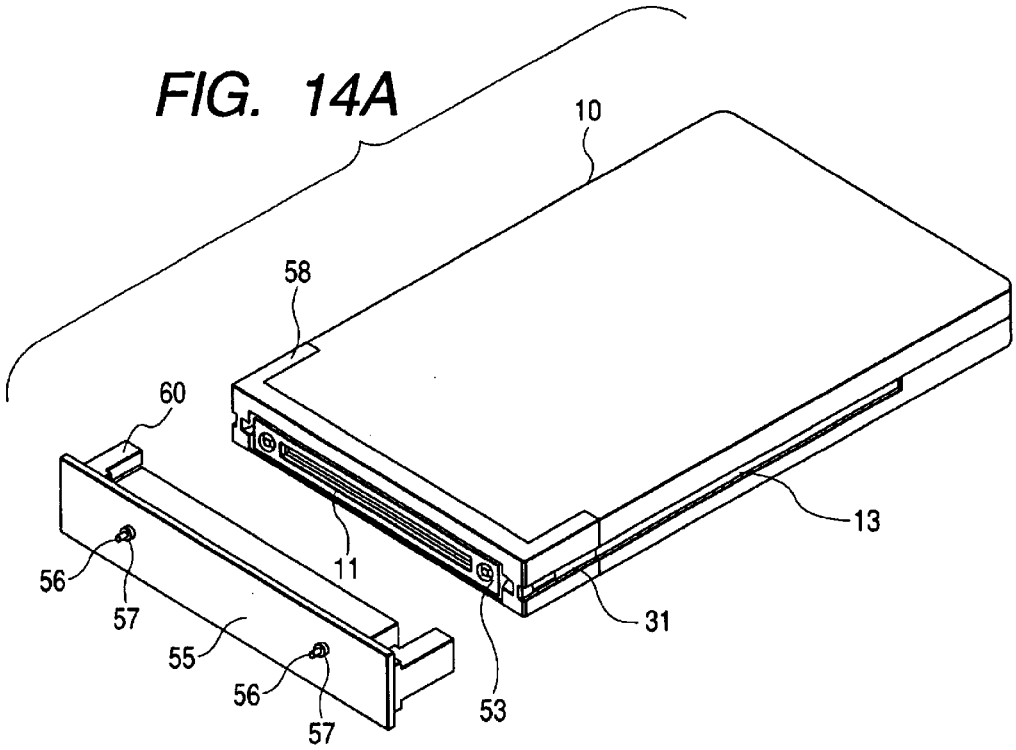
FIGS. 14A and 14B are perspective views of an electronic equipment and connectors according to a third embodiment.
Figure 14B:
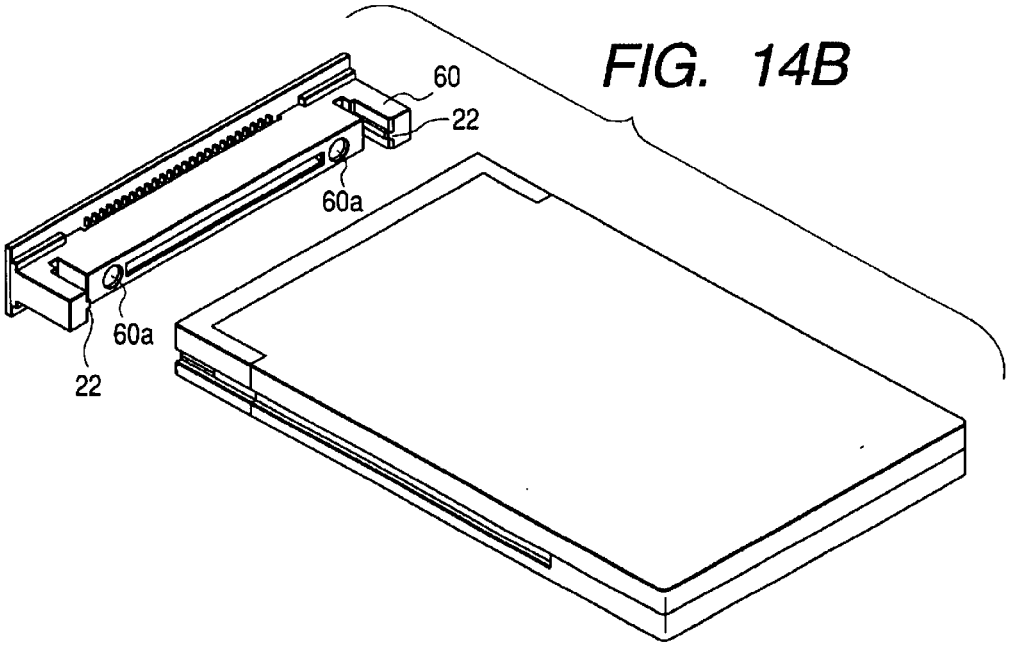

FIGS. 14A and 14B are perspective views, viewed from directions different from each other, of electronic equipment and connectors according to the third embodiment.

Figure 15A:
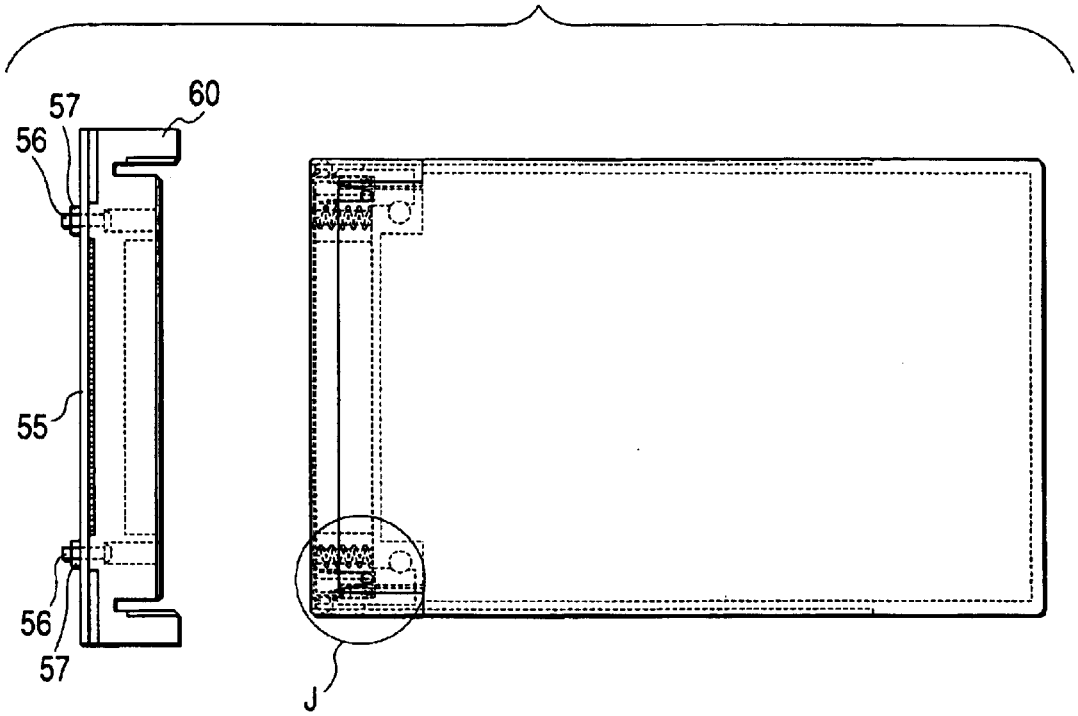
FIGS. 15A and 15B are plan views viewed, from above, an electronic equipment according to a third embodiment.
Figure 15B:
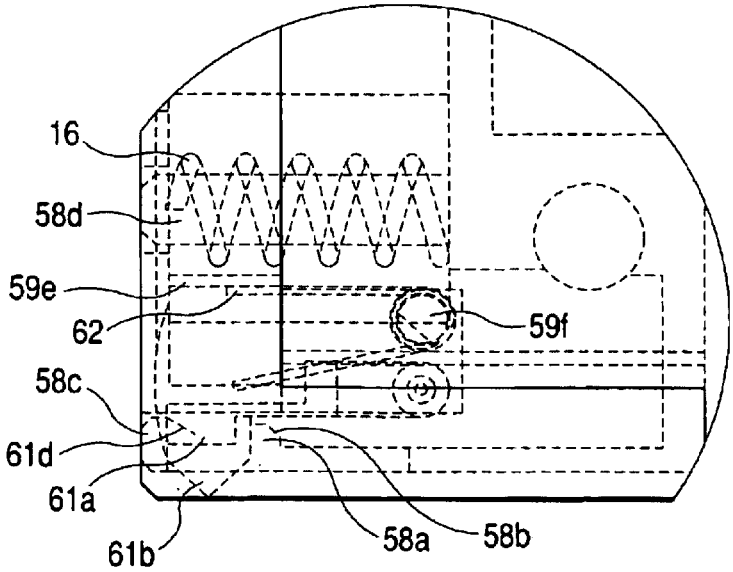
Figure 16A:
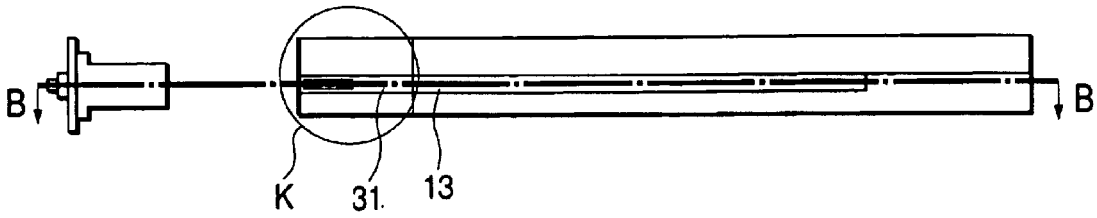
FIGS. 16A and 16B are right side views of an electronic equipment according to a third embodiment.
Figure 16B:
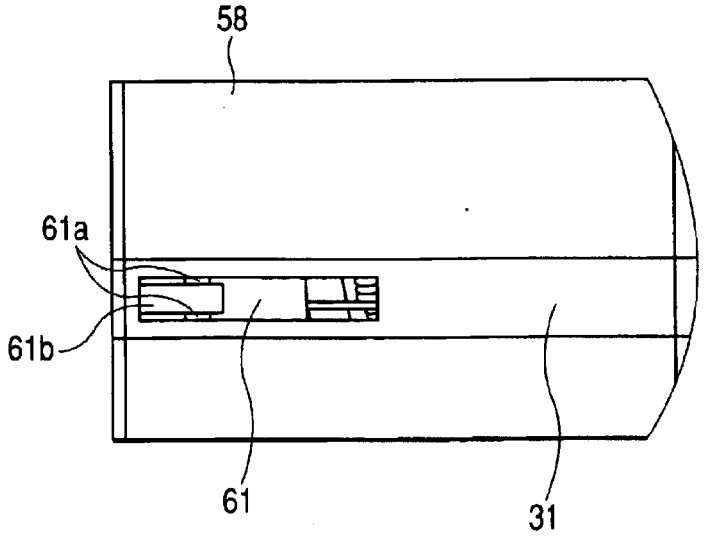
Figure 17A:
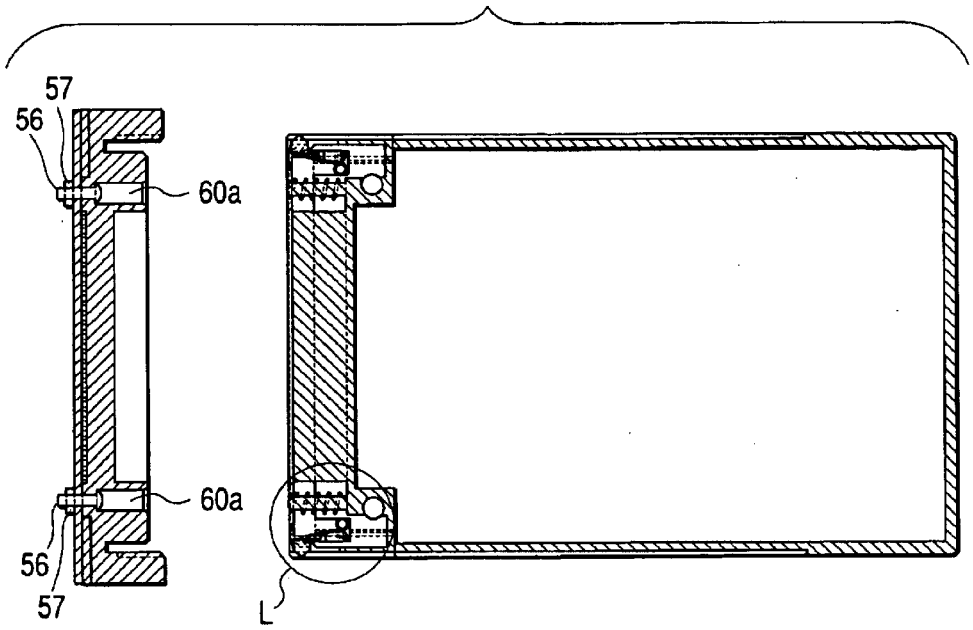
FIGS. 17A and 17B are sectional views taken on line B—B in FIG. 16A, FIGS. 18A and 18B are sectional views displaying lock release mechanism portions in a third embodiment.
Figure 17B:
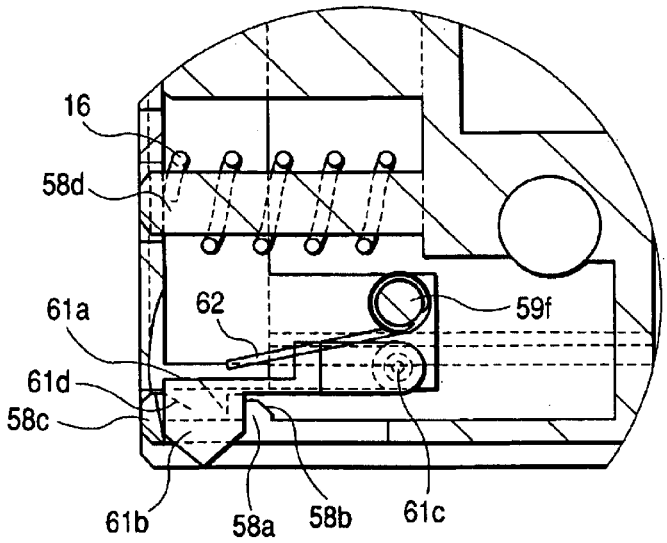

FIG. 15A is a plan view viewed (partially drawn in perspective), from above direction, the electronic equipment according to the third embodiment, FIG. 15B is an enlarged view of a J portion in FIG. 15A. Further, FIG. 16A is a right side view of the electronic equipment according to the third embodiment, FIG. 16B is an enlarged view of a K portion in FIG. 16A, FIG. 17A is a sectional view taken on line B—B in FIG. 16A, and FIG. 17B is an enlarged view in a L portion in FIG. 17A.

A container 10 is mounted with a connector 58 connecting to a connector 60, and a connection portion 11 of the connector 58 is covered by a shutter 59. The shutter 59 is pushed in a left direction in FIG. 15A by springs 16 inserted into shafts 58*d* integrally installed with the connector 58, and is constituted such that the shutter 59 is not detached from an inner portion of the connector 58 by stoppers 58*c*.

Next, a lock mechanism of the shutter 59 will be described in detail.

Figure 21A:
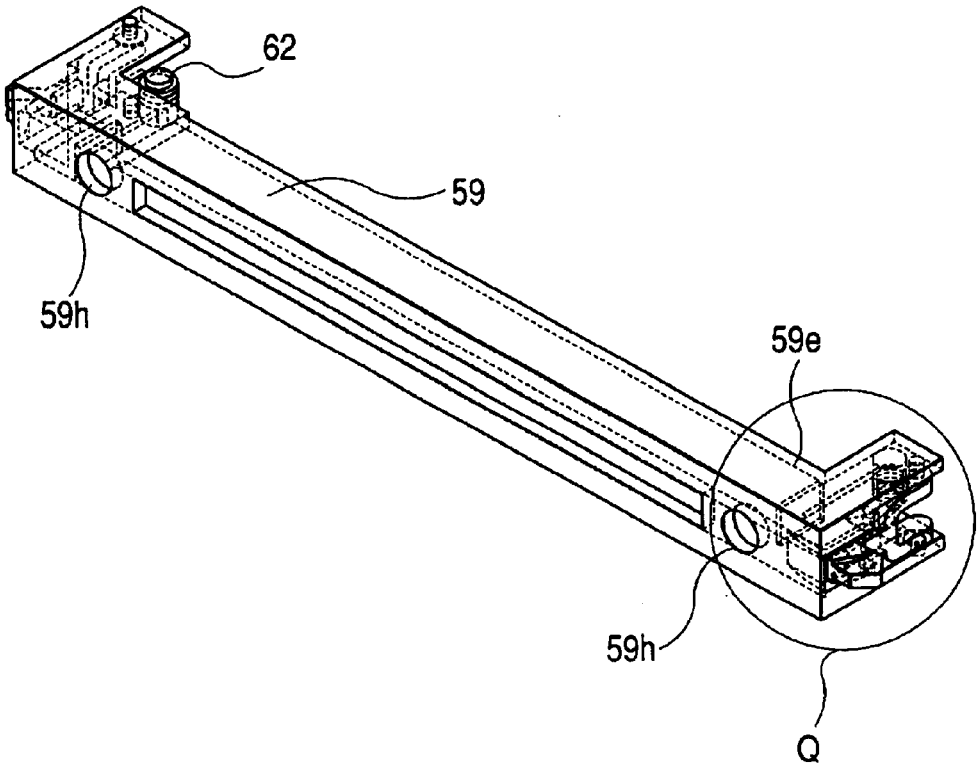
FIGS. 21A and 21B are perspective views displaying a unit portion alone of a shutter 59.
Figure 21B:
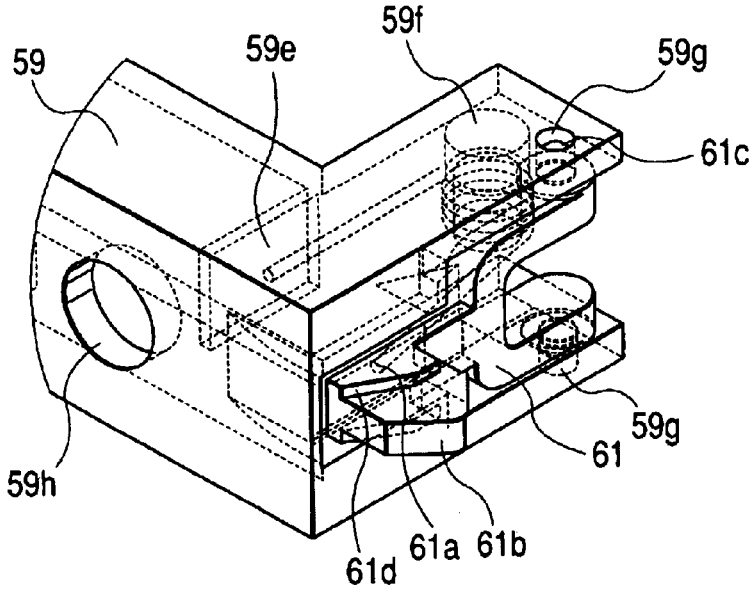
Figure 22A:
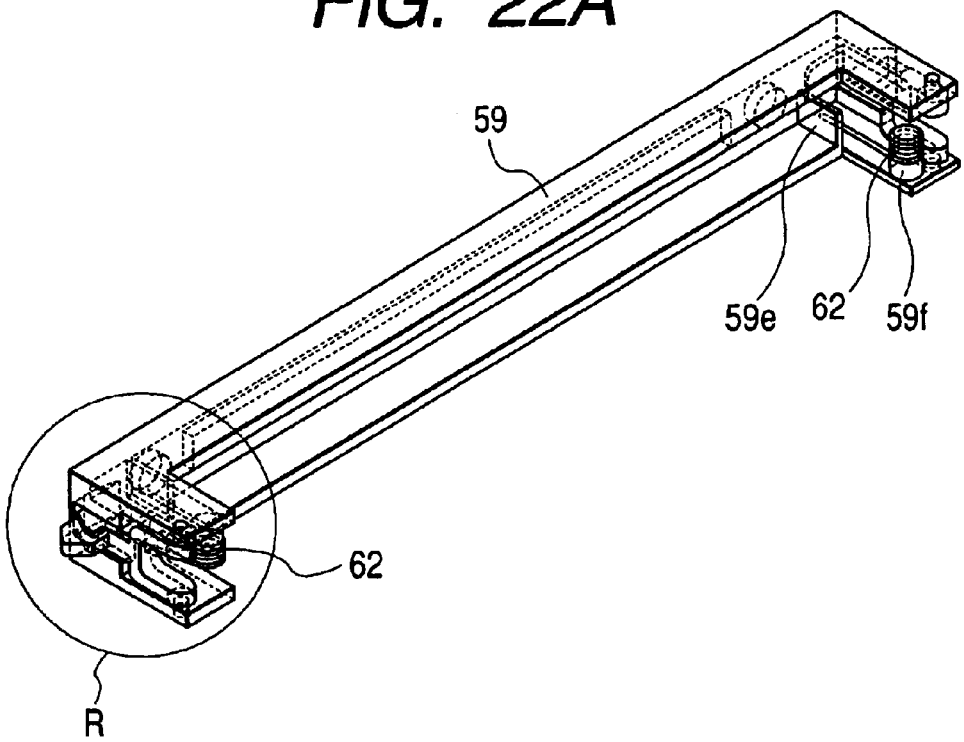
FIGS. 22A and 22B are perspective views displaying a unit portion alone of a shutter 59.
Figure 22B:
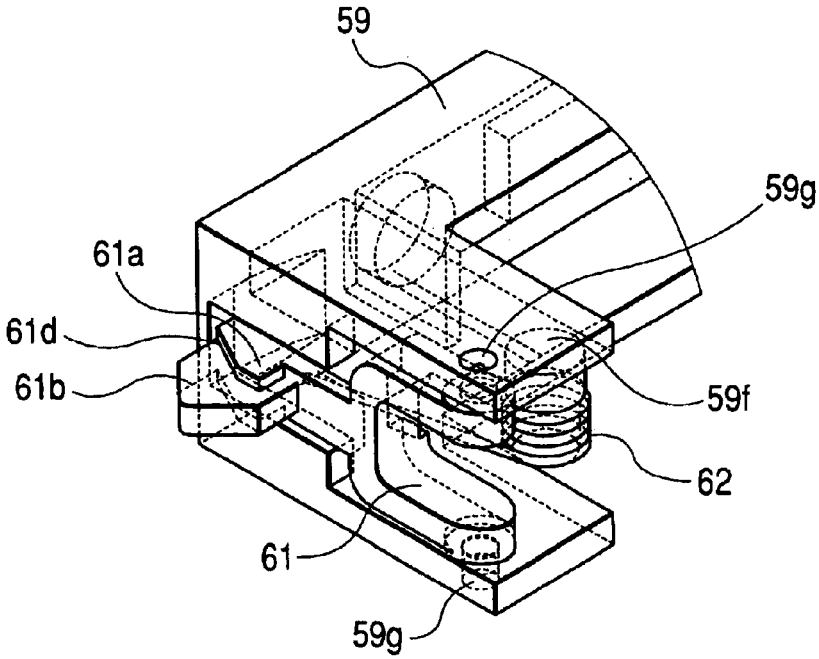

FIG. 21A and FIG. 22A are perspective views displaying (partially drawn in perspective) a unit portion alone of the shutter 59, and are displayed from directions different from each other. FIG. 21B is an enlarged view of a Q portion in FIG. 21A, and FIG. 22B is an enlarged view of an R portion in FIG. 22A.

The shutter 59 is provided with holes 59*g*, and shafts 61*c* of levers 61 are inserted. The levers 61 are integrally installed with projection portions 61*b* pushed by the lock releasing portions 22 and claw portions 61*a* for locking the shutter, further, slant faces 61*d* are formed on upper portions of the claw portions 61*a*. Further, shafts 59*f* are provided in the shutter 59, and coil springs 62 are inserted into the shafts 59*f*. One side of a lever portion of each of the coil springs 62 is brought into pressure contact with a wall 59*e* integrally installed with the shutter 59, and the other side thereof is brought into pressure contact with the lever 61. As a result, the levers 61 are pushed such that the levers are rotated to outsides by making the shafts 61*c* as rotation center.

Figure 18A:
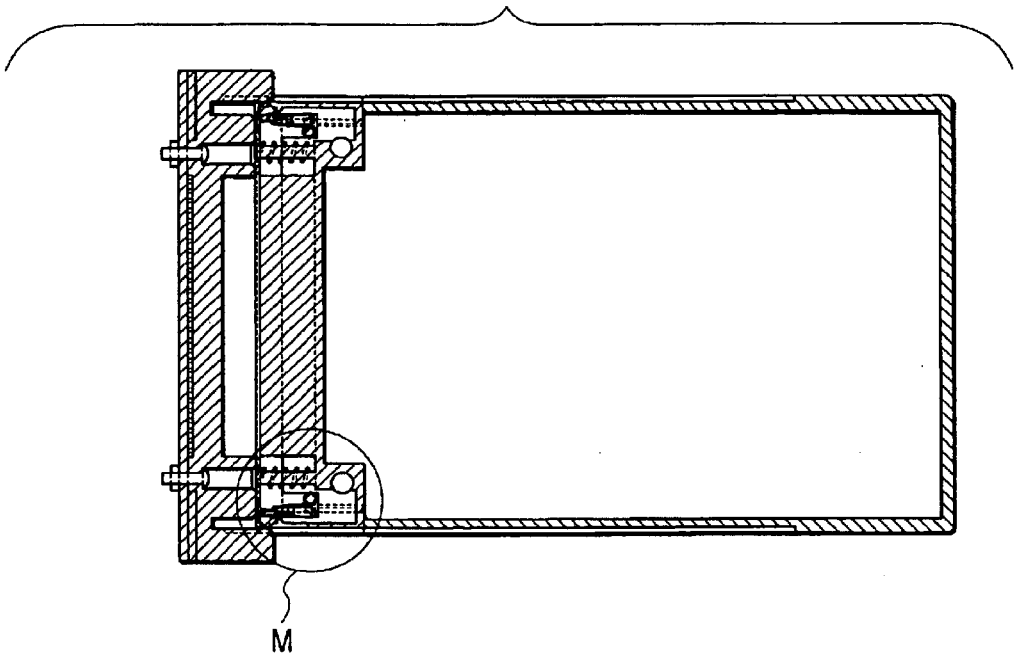
Figure 18B:
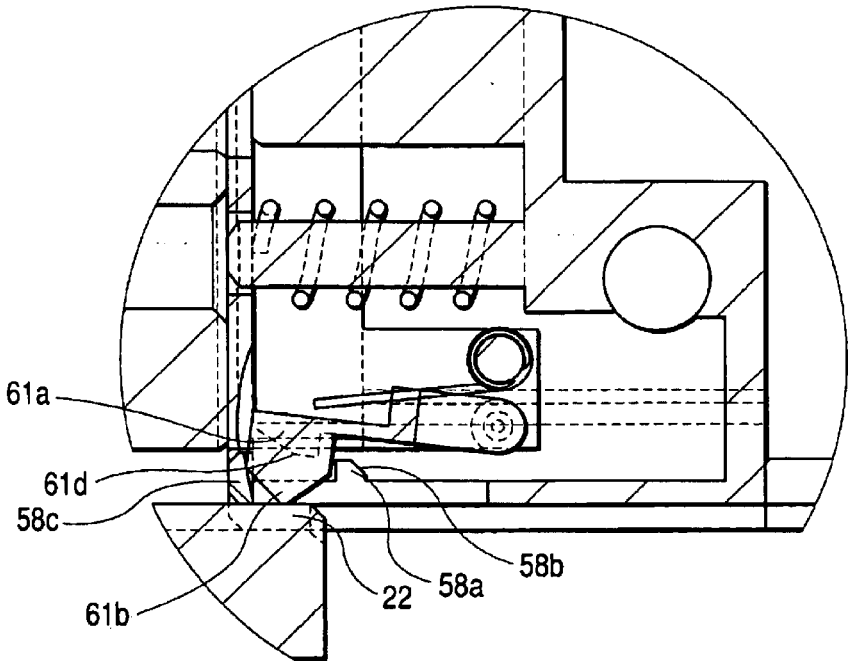
Figure 19A:
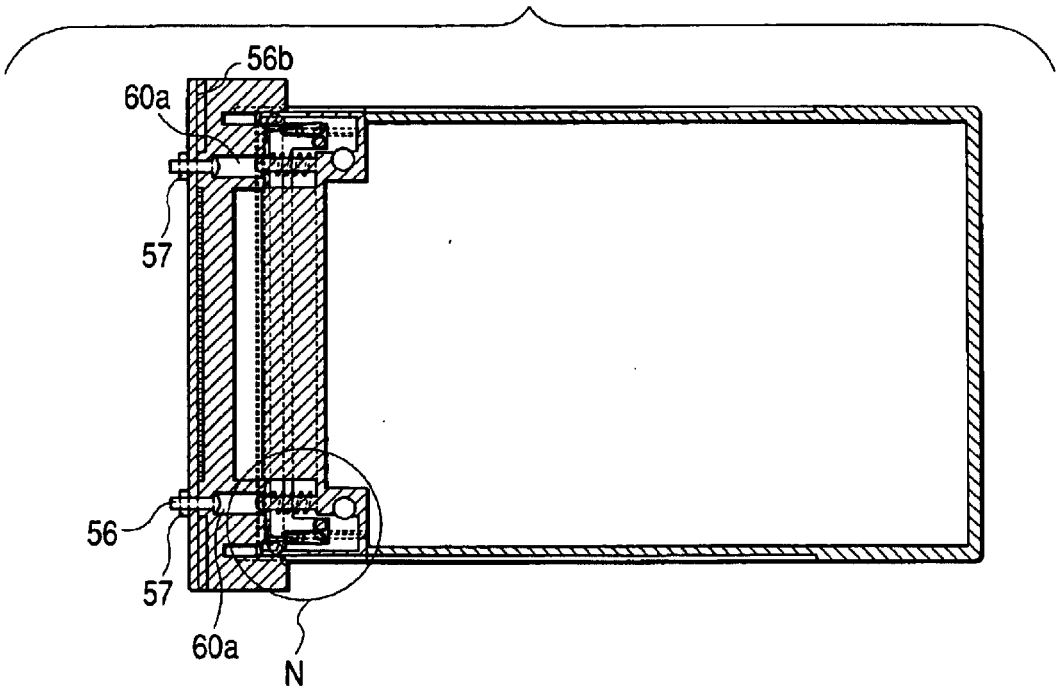
FIGS. 19A and 19B are sectional views displaying lock release mechanism portions in a third embodiment.
Figure 19B:
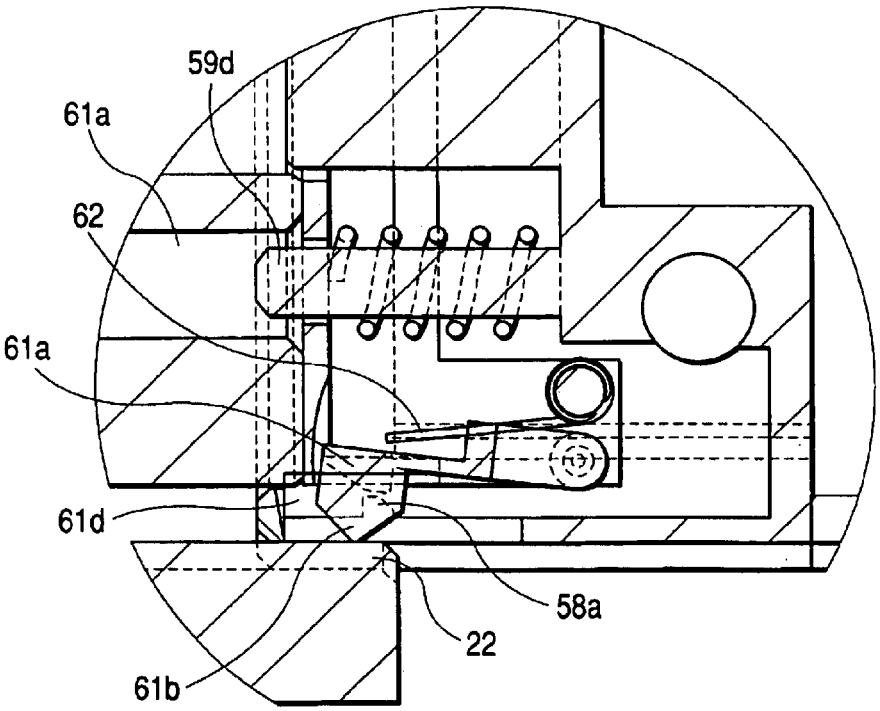
Figure 20A:
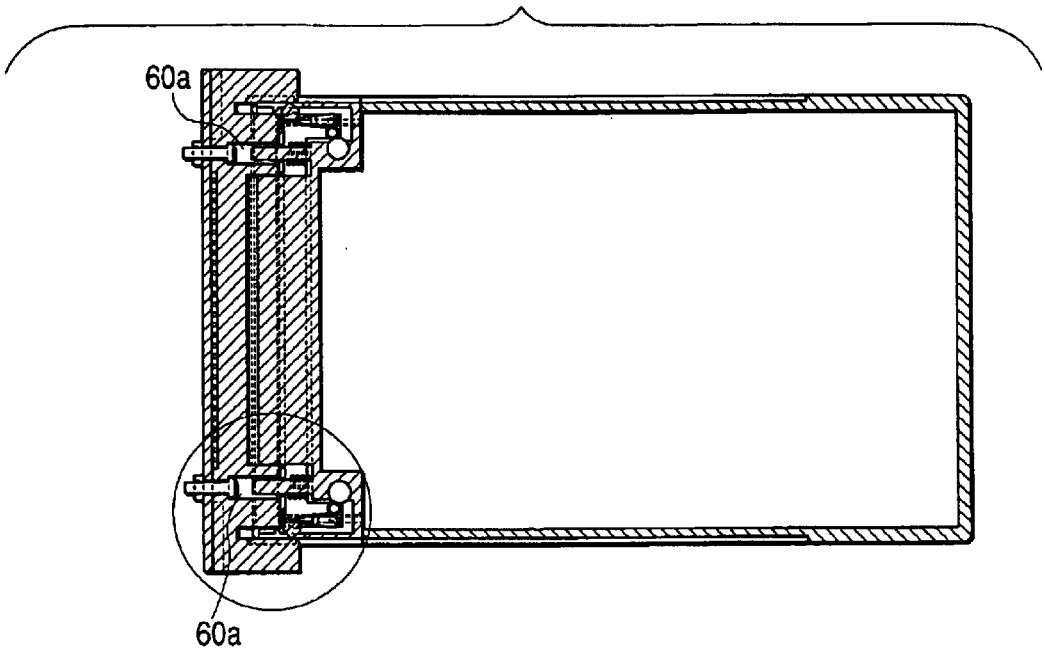
FIGS. 20A and 20B are sectional views displaying lock release mechanism portions in a third embodiment.
Figure 20B:
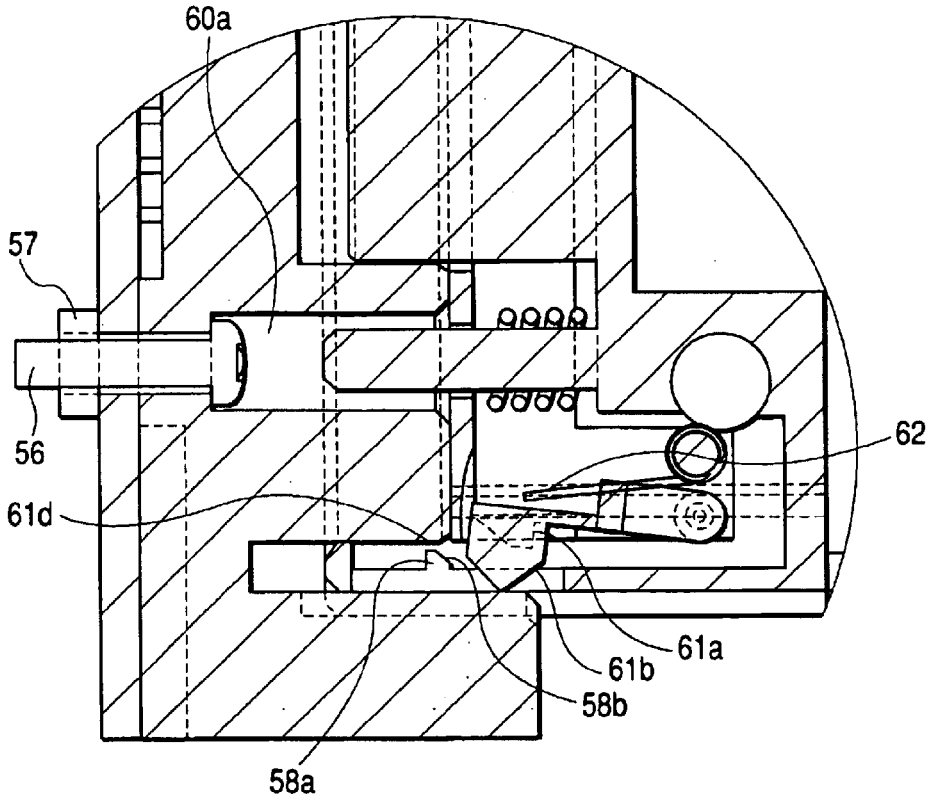

FIGS. 18A, 19A, and 20A are sectional views displaying step by step in a state where the connector 60 is inserted into the connector 58 while pushing down the shutter 59, FIG. 18B is an enlarged view of a M portion in FIG. 18A, FIG. 19B is an enlarged view of a N portion in FIG. 19A, and FIG. 20B is an enlarged view of a P portion in FIG. 20A.

In a state as shown in FIG. 17B, since the connector 60 is not inserted, a thrust direction of the shutter 59 is restricted in a state where the springs 16 push up the shutter 59, and each of the lever 61 is run into the stopper 58*c* of the connector 58. Although a direction of rotation of each of the levers 61 is pushed to the outside by the coil spring 62, as shown in FIG. 17B and FIG. 16B, the claw portion 61*a* strikes on a side face of inside of the connector 58, so that a direction of rotation of each of the levers 61 is restricted. Even when the shutter 59 is pushed in this state, the claw portions 61*a* are caught by lock portions 58*a* and cannot slide into more inner portion than that.

FIG. 18A displays a state where although the lock releasing portions 22 of the connector 60 are brought into pressure contact with the projection portions 61*b*, and push down the levers 61 to insides of the connector 58, the shutter 59 is not yet pushed down.

Further, FIG. 19A displays a state where the connector 60 is inserted into inside of the connector 58, the claw portions 61*a* are not caught by the lock portions 58*a* and the shutter 59 continues sliding, and FIG. 20A displays a state where the connector 60 is completely inserted into the connector 58.

Meanwhile, by any method, when the levers 61 of both sides are pushed to the insides, the shutter 59 is possible to be pushed down. Supposing that in a state where the shutter 59 is lowered in this manner, the levers 61 are made free, and further, the shutter 59 is also made free, the shutter 59 is pushed up upward, the levers 61 move upward while being pushed to wall sides of the connector 58. Since the levers 61 move upward while being pushed to an inner wall of the connector 58, the claw portions 61*a* and the lock portions 58*a* are interfered with each other. However, slant faces 61*d* are formed on upper portions of the claw portions 61*a* of the levers 61, and since slant faces 58*d* are formed also in the lock portions 58*a*, when the levers 61 strike the lock portions 58*a*, the levers 61 rotate to the insides, climb over the lock portions 58*a*, and until the projection portions 61*b* strike the stoppers 58*c* the shutter 59 moves upward.

Furthermore, the connector 60 is soldered to a printed wiring board 55, the connector 60 is provided with stepped holes 60*a* so as to escape from shafts 58*d*. In addition, holes are provided also in the printed wiring board 55 at positions corresponding to the stepped holes 60*a*, and by using these holes, the connector 60 and the printed wiring board 55 are constituted so that they are powerfully fixed to each other by the screws 56 and nuts 57.

In the present embodiment, the printed wiring board 55 is fixed to the connector 60 by bringing the nuts 57 into contact with the printed wiring board 55 side, however, it is not objectionable to fix the printed wiring board 55 by bringing heads of the screw 56 into contact with the printed wiring board 55 side. Moreover, the nuts 55 may be previously insert molded into the holes 60*a*.

Alternatively, by using self-tapping screws having outer diameters slightly larger than inner diameters of the holes 60*a*, and they are screwed from the printed wiring board 55 side, then it is unnecessary to use the nuts 57, whereby cost can also be reduced.

Fourth Embodiment

Next, an auto-loading apparatus in an information processing unit (such as personal computer) using above described electronic equipment (removable hard disk) will be described.

Figure 23:
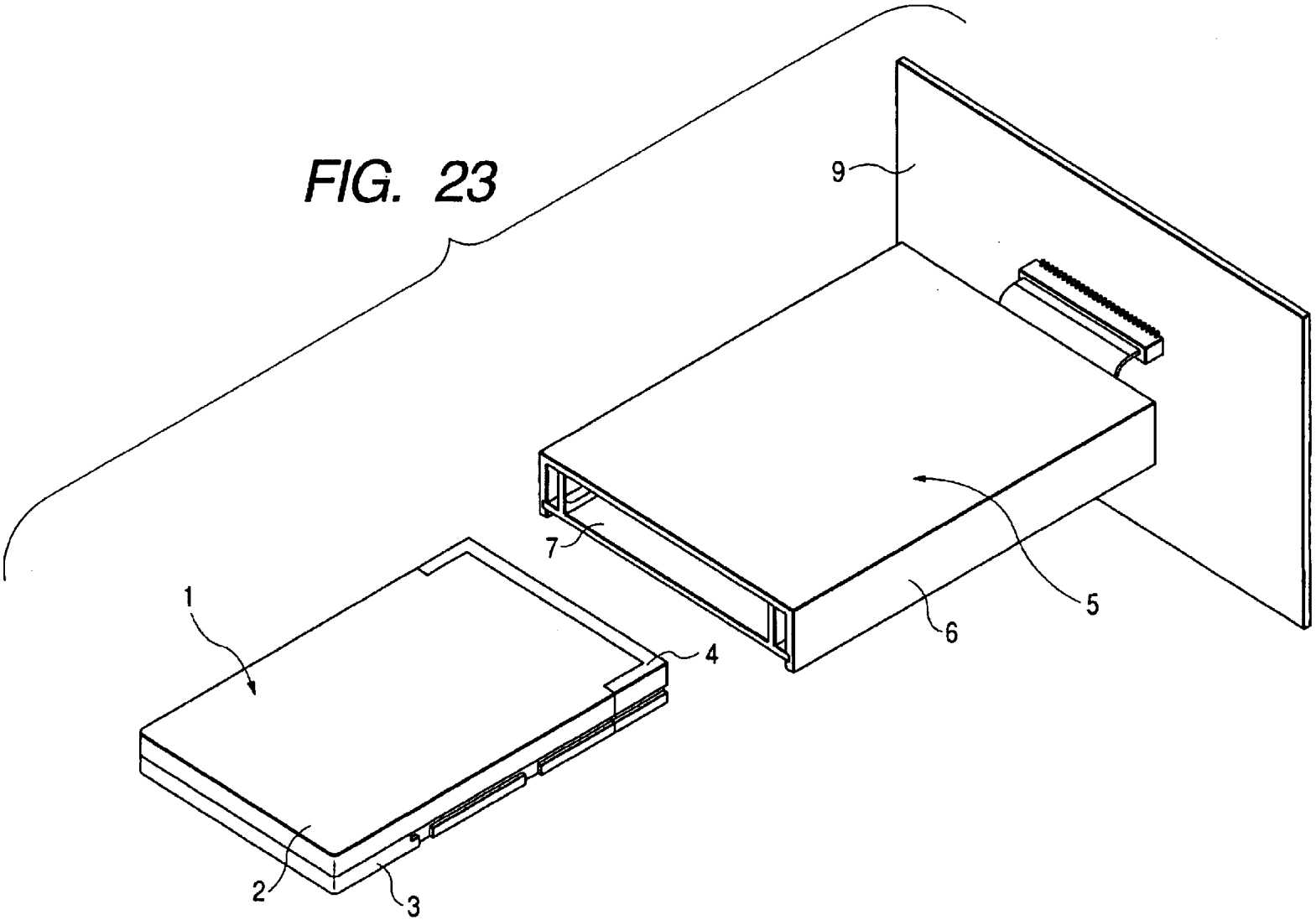
FIG. 23 is a perspective view viewed, obliquely from the above and right, an auto-loading apparatus according to a fourth embodiment.
Figure 24:
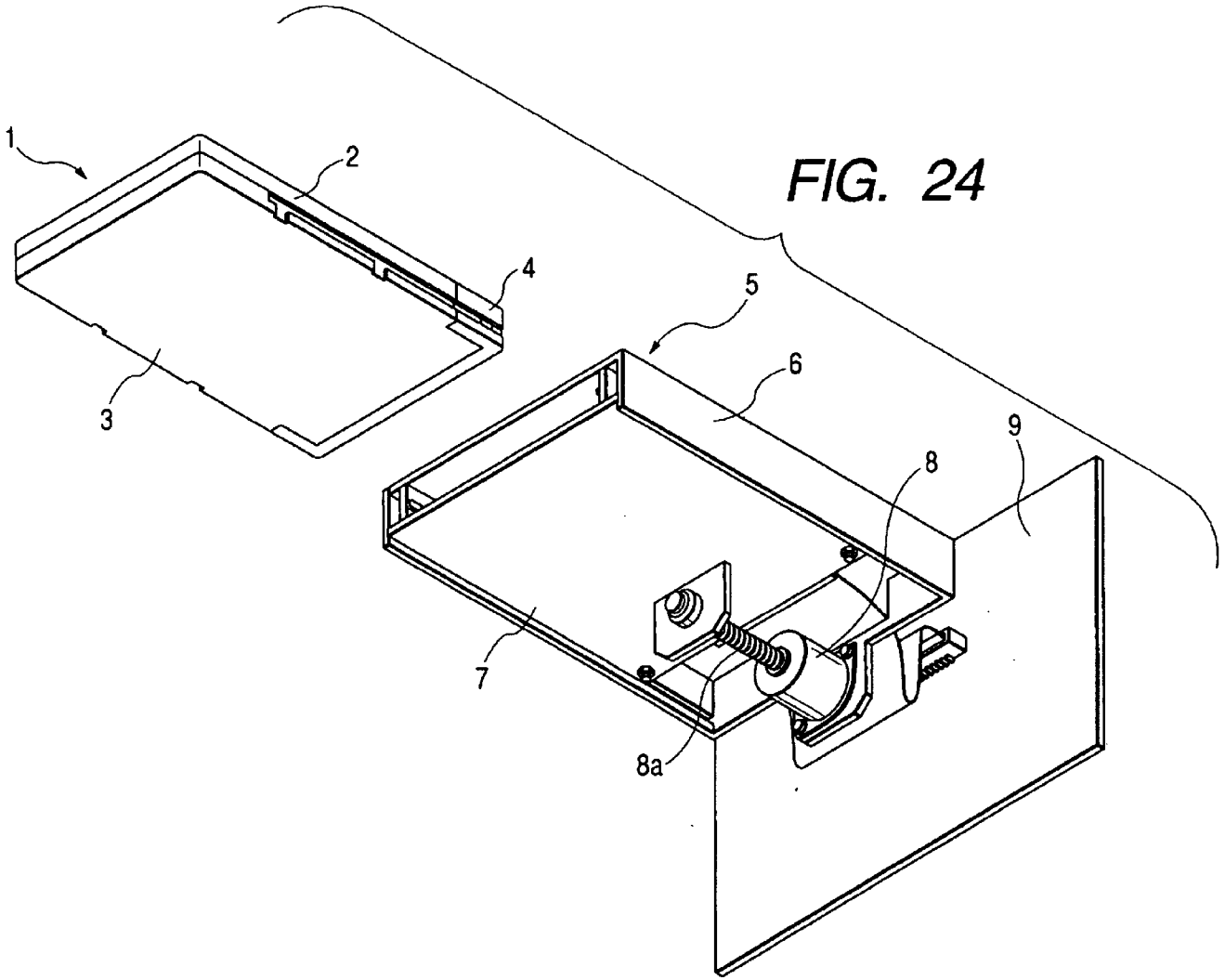
FIG. 24 is a perspective view viewed, obliquely from the below and right, an auto-loading apparatus according to a fourth embodiment.

FIGS. 23 and 24 are perspective views viewed, obliquely from the above and right, and from the below and right, a removable hard disk 1 and an auto-loading apparatus 5 of the removable hard disk according to the present embodiment. Meanwhile, the auto-loading apparatus 5 is provided on such as the personal computer, and FIG. 23 and FIG. 24 are views showing a part of the personal computer (hereinafter referred to as PC) and the auto-loading apparatus 5.

In FIGS. 23 and 24, numeral 1 denotes a removable hard disk, and is constituted of a top case 2, a bottom case 3 and a connector 4. In addition, such as a cushioning material for absorbing impact, a hard disk, a flexible printed board are incorporated in inside thereof. Meanwhile, these are all well known generally, therefore detailed explanation will be omitted.

Numeral 5 denotes an auto-loading apparatus of removable hard disk 1, and is constituted of such as a frame 6, a palette 7, and a pulse motor 8. Numeral 9 denotes a part of a main PCB such as PC for controlling such as the removable hard disk or auto-loading apparatus, and mounted with such as a CPU 135 which will be described later. Meanwhile, the removable hard disk has a structure as has explained in the first through the third embodiments described above.

Figure 25:
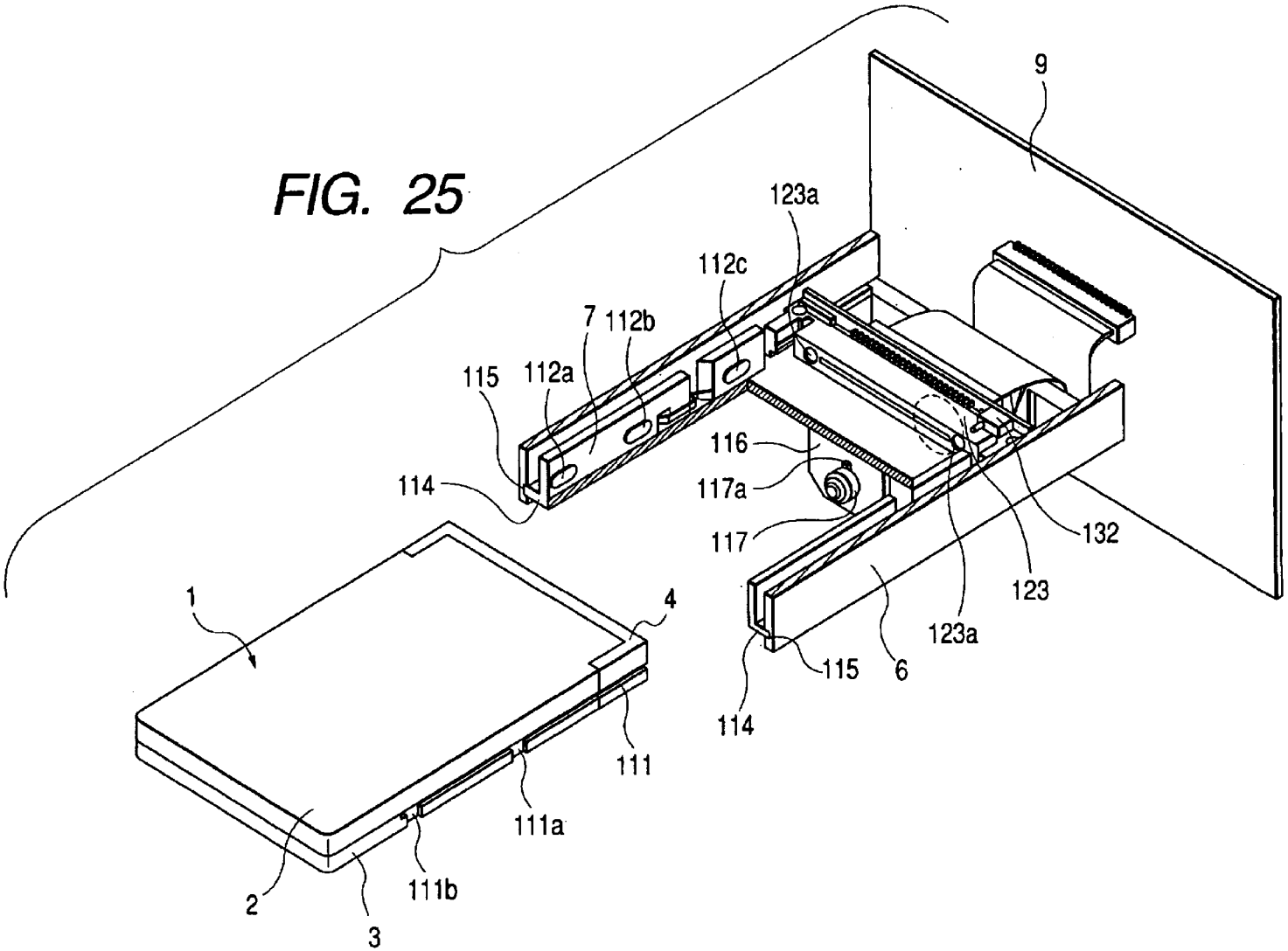
FIG. 25 is a perspective view viewed, from a position similar to that of in FIG. 23, an auto-loading apparatus, which is uncovered by removing parts of components residing above and below of the auto-loading apparatus according to a fourth embodiment.
Figure 26:
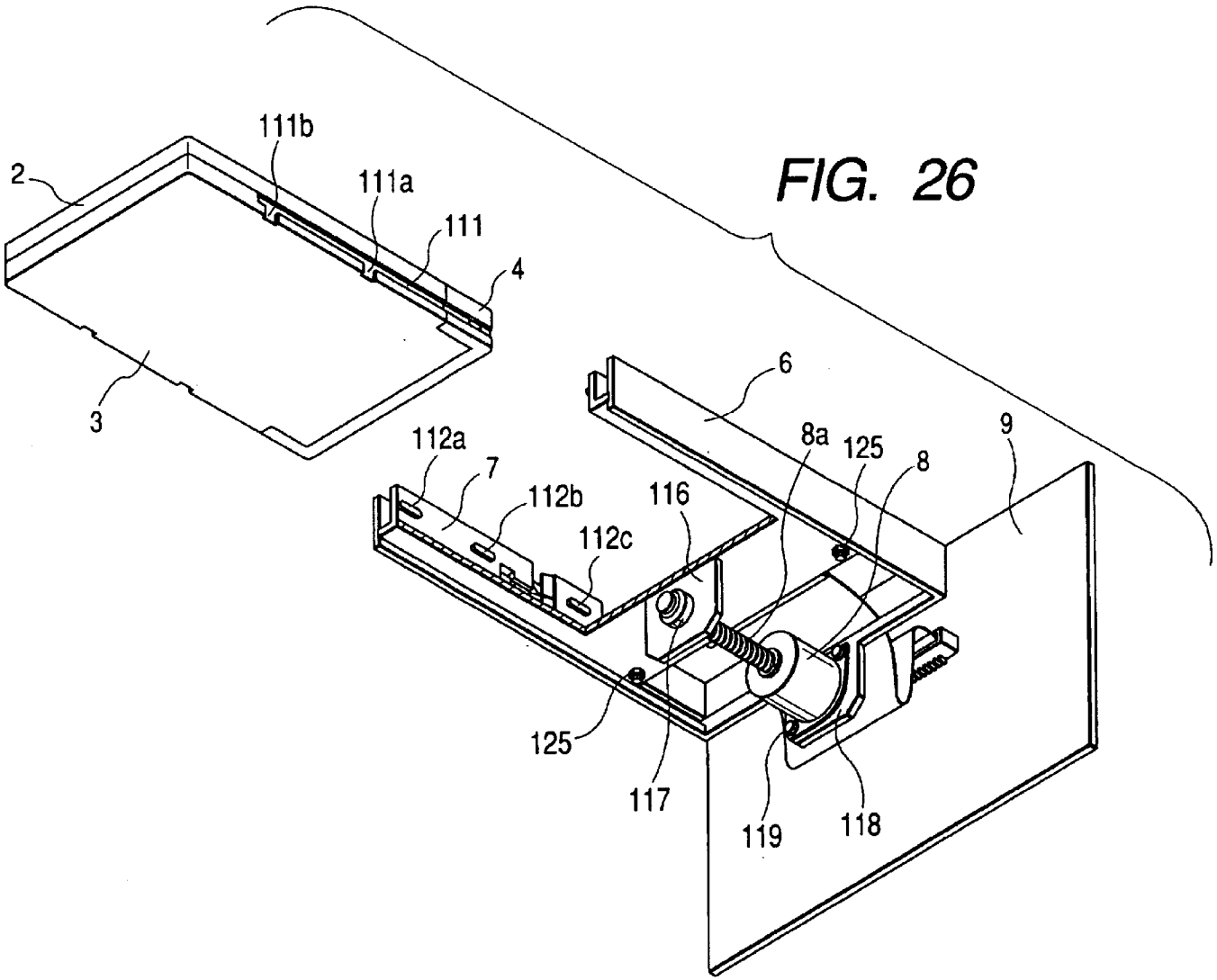
FIG. 26 is a perspective view viewed, from a position similar to that of in FIG. 24, an auto-loading apparatus, which is uncovered by removing parts of components residing above and below of the auto-loading apparatus according to a fourth embodiment.
Figure 27:
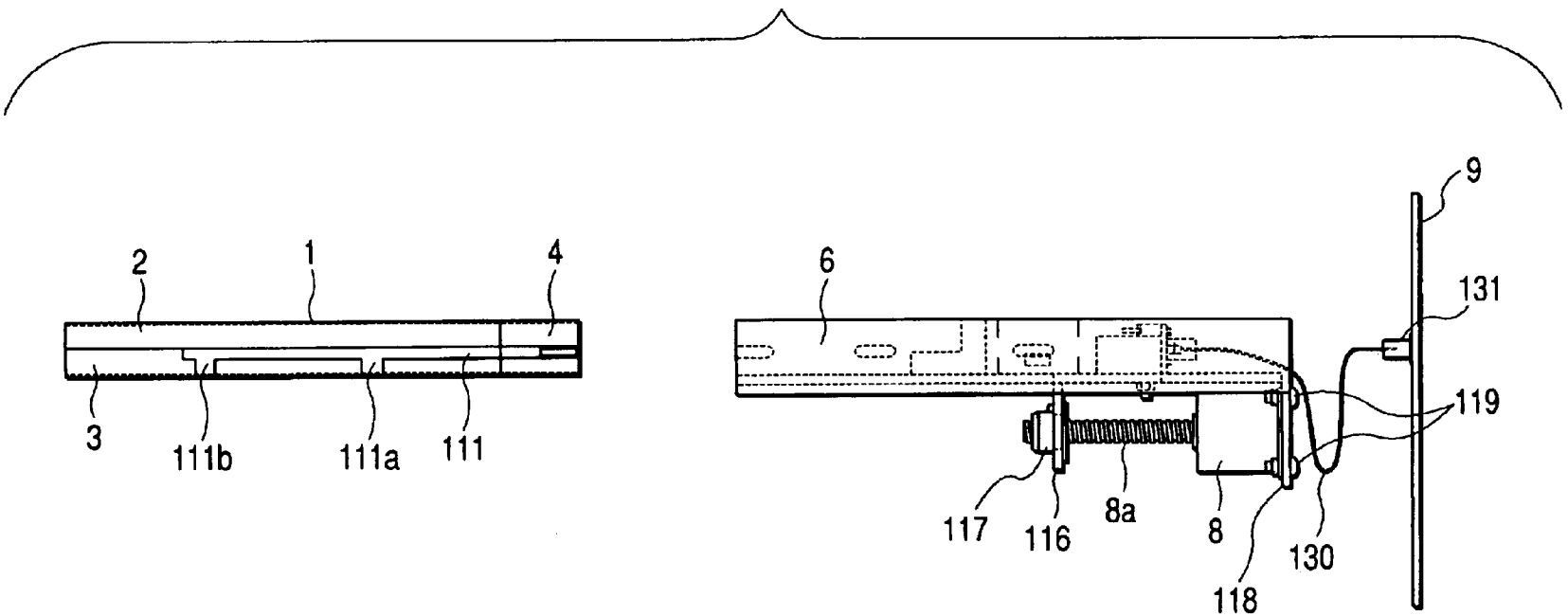
FIG. 27 is a side view viewed, from a right side, an auto-loading apparatus in states shown in FIGS. 25 and 26.

FIGS. 25 and 26 are perspective views (partially cut model) viewed, from the same direction as in FIGS. 23 and 24, the apparatus which are opened an upper portion of the frame 6 of the auto-loading apparatus 5 for the removable hard disk 1 displayed in FIGS. 23 and 24, further also opened a lower portion of the palette 7. FIG. 27 is a side view viewed, from a right side, the state described above, and FIG. 28 is a plan view (partially cut model) viewed, from the above, the state described above.

Grooves 111 linked to those of the connector 4 are provided on left and right sides of the removable hard disk 1, and lock grooves 111*a* and 1111*b* are provided in a direction at right angle to the grooves 111. Oval shaped projection portions 112*a*, 112*b*, and 112*c* are provided on left and right sides of an inside of the palette 7 for the auto-loading apparatus 5 so as to be fitted with the grooves 111, and the removable hard disk 1 is inserted into inside of the auto-loading apparatus 5 along the projection portions 112*a*, 112*b*, and 112*c*.

Projection portions 114 are provided on left and right sides of outsides of the palette 7, and slidably inserted into grooves 115 provided on left and right sides of inside of the frame 6. Further, a mounting plate 116 is integrally installed with the pallet 7 on a bottom surface thereof, and a bearing 117 is press-fitted into the mounting plate 116. Meanwhile, a projection portion 117*a* is provided in the bearing 117 in order to receive force in a radial direction.

A mounting plate 118 is integrally installed with the frame 6 on a bottom surface of the frame 6, and a pulse motor 8 is fixed to the mounting plate 118 by screws 219.

The pulse motor 8 is constituted such that a lead screw shaft 8*a* functions as an axis of rotation, when the shaft 8*a* rotates counter clockwise, viewed from a direction of the shaft 8*a*, the shaft 8*a* is engaged with the bearing 217 so that the palette 7 moves closer to the pulse motor 8.

Figure 28:
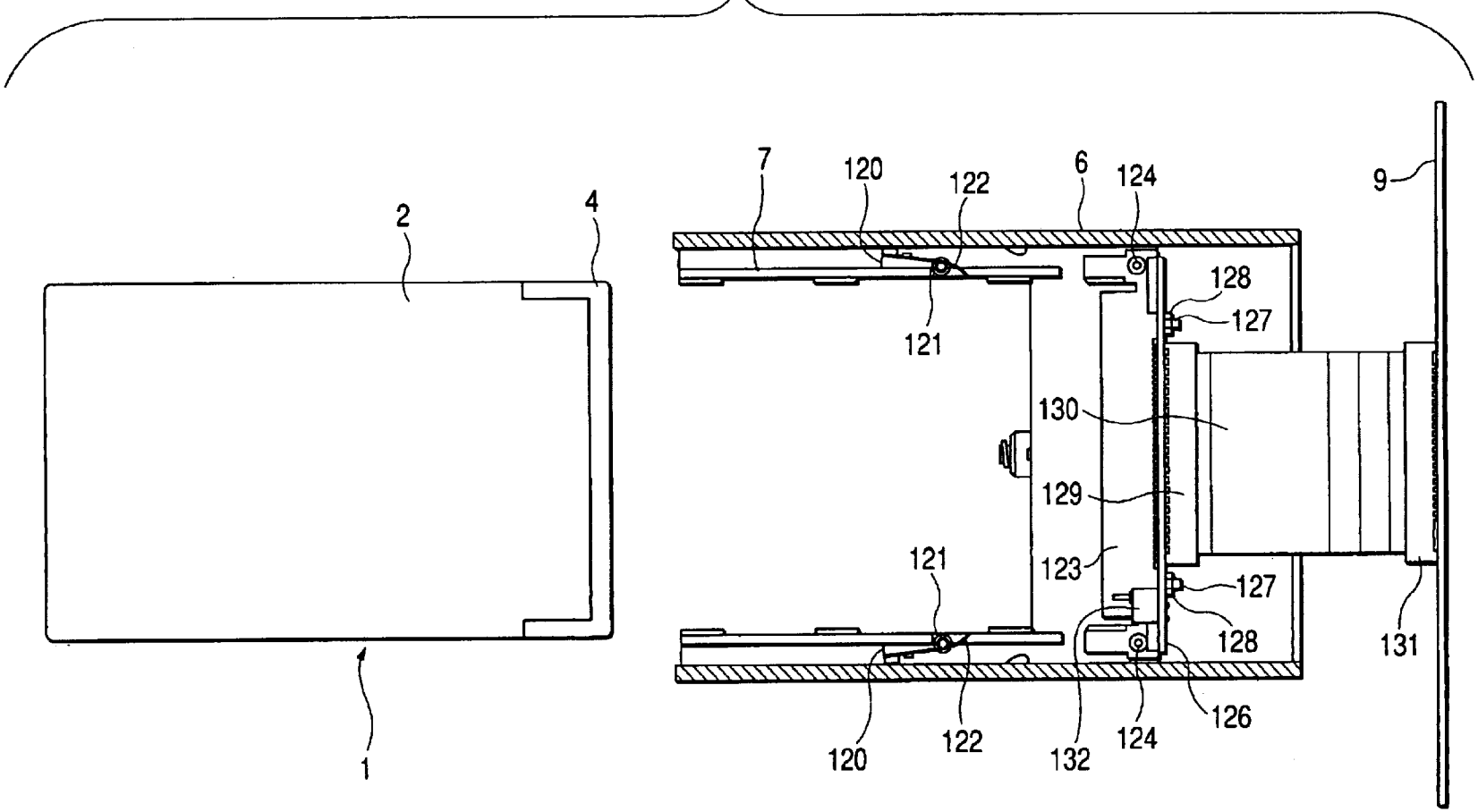
FIG. 28 is a plan view viewed, from above, an auto-loading apparatus in states shown in FIGS. 25 and 26.

In FIG. 28, shafts 121 are provided on left and right of upper portion of the palette 7, claws 120 are rotatably inserted into both shafts 121, and the claws 120 are energized in a manner to open to outsides by springs 122 inserted into the shafts 121.

In addition, a connector 123 electrically connected to the connector 4 of the removable hard disk 1 is provided on an upper portion of the palette 7, and the connector 123 is rigidly fixed to the palette 7 by the screws 124 and nuts 125. The connector 123 is soldered to a PCB 126, and electrically coupled to each other. Moreover, the connector 123 is mechanically firmly fixed (refer to FIGS. 33A and 33B) to the PCB 126 by screws 127 and nuts 128 using stepped holes 123*a* provided in the connector 123.

A connector 129 for flexible cable is soldered on a rear face of the PCB 126, and one end of a flexible cable 130 is inserted into the connector 129 to be electrically coupled to each other. The other end of the flexible cable 130 is inserted into a connector 131 soldered to a main PCB 9. Further, a switch 132 which detects complete coupling of the removable hard disk 1 to the connector 123 is soldered to the PCB 126. Meanwhile the pulse motor 8 is electrically coupled to the PCB 9 by a lead wire and connector not shown. According to a constitution described above, the removable hard disk 1 is possible to transmit and receive data between itself and such as the CPU 135 mounted on the main PCB 9 via the connector 4, connector 123, connector 129, flexible cable 130, and connector 131.

Next, with regard to the auto-loading apparatus 5 having above-described constitution, actual operation will be described in detail. Meanwhile, following control is carried out by control of the CPU 135.

Figure 38:
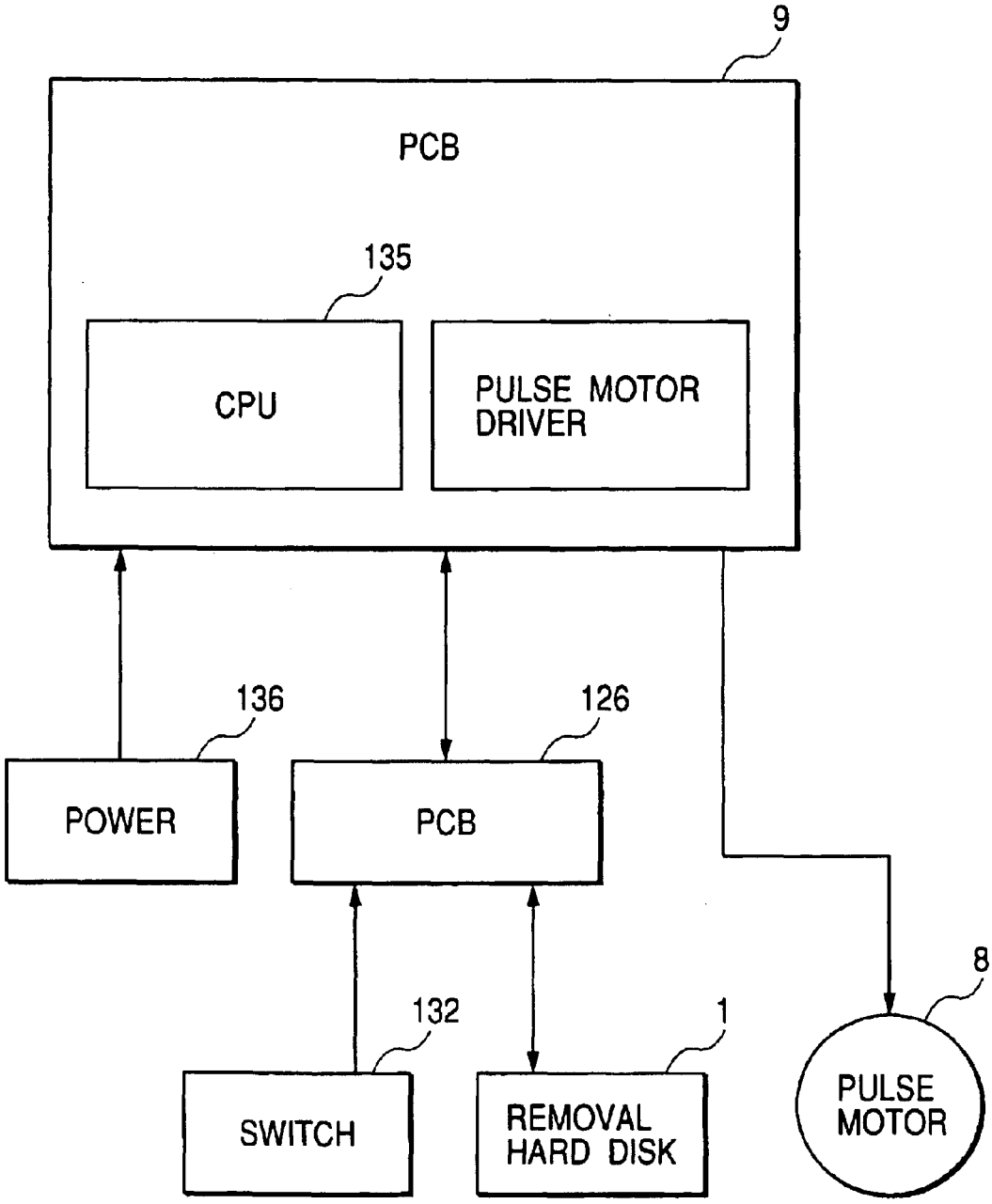
FIG. 38 is a block diagram of an auto-loading apparatus according to a fourth embodiment.
Figure 39:
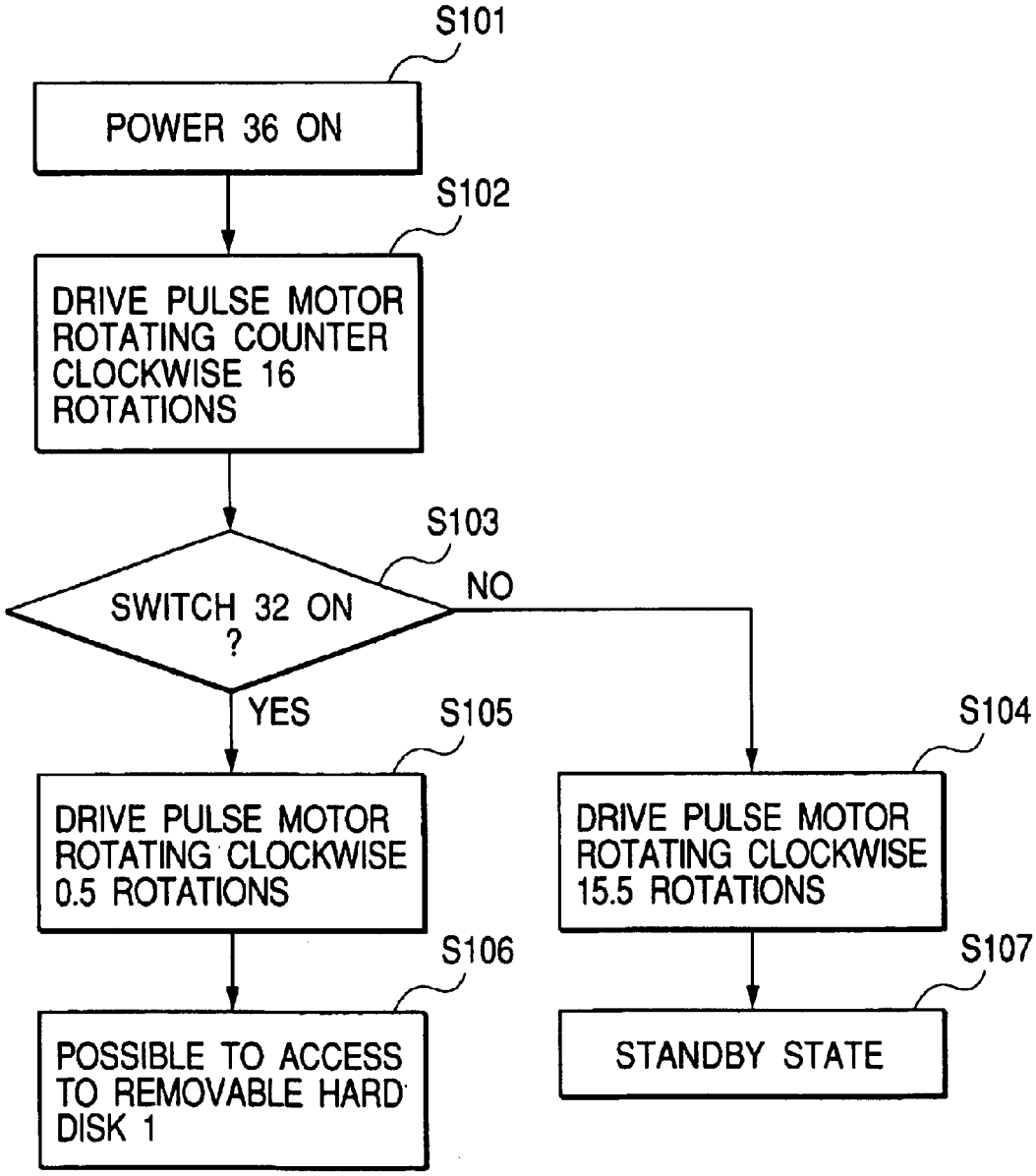
FIG. 39 is a flow chart for explaining an operation of an auto-loading apparatus when power is in an on-state.

FIG. 38 is a block diagram of the auto-loading apparatus 5, and FIG. 39 is a flow chart displaying an operation of auto-loading apparatus 5 when power 136 is in an ON state.

In the present embodiment, the pulse motor 8 is constituted in setting to drive it to rotate clockwise 15.5 rotations in order to move the palette 7 from a state where the palette 7 is moved to a striking portion on a side of the pulse motor 8 to a state where the removable hard disk is not installed (refer to FIGS. 23 and 24). Further, the pulse motor 8 is constituted in setting to drive it to rotate clockwise 0.5 rotations, in order to move the palette 7 from a state where it is moved to striking portions on the side of the pulse motor 8 to a state (refer to FIGS. 34 and 35) where the removable hard disk is drawn into the apparatus. Accordingly, even when the palette 7 stays in any position, by driving the pulse motor 8 to rotate counter clockwise 16 rotations, the palette 7 can move to the striking portion.

At step 101, when power is in the ON state by an instruction from a user, at step 102 pulses are sent so that the pulse motor 8 is driven to rotate counter clockwise 16 rotations by an order from the CPU 135. Even when the palette 7 stays in any position, the palette 7 runs into a striking on a side of the connector 123 by this driving, and the pulse motor 8 stops while losing synchronism.

Next, at step 103, it is determined whether the switch 132 is ON or OFF (it is same as to determine whether removable hard disk 1 is inserted or not). When the switch 132 is ON, the process proceeds to step 105, after driving the pulse motor 8 to rotate clockwise 0.5 rotations, the process proceeds to step 106, and it become a state where access is possible from such as the CPU 135 to the removable hard disk 1. When the switch 132 is OFF, the process proceeds to step 104, the pulse motor 8 is driven to rotate clockwise 15.5 rotations, and after proceeding to step 107, initial processing after power is turned on, is finished, and process is brought into stand-by state.

In following description, a case where the process proceeds to stand-by state at step 107 will be described.

Figure 29:
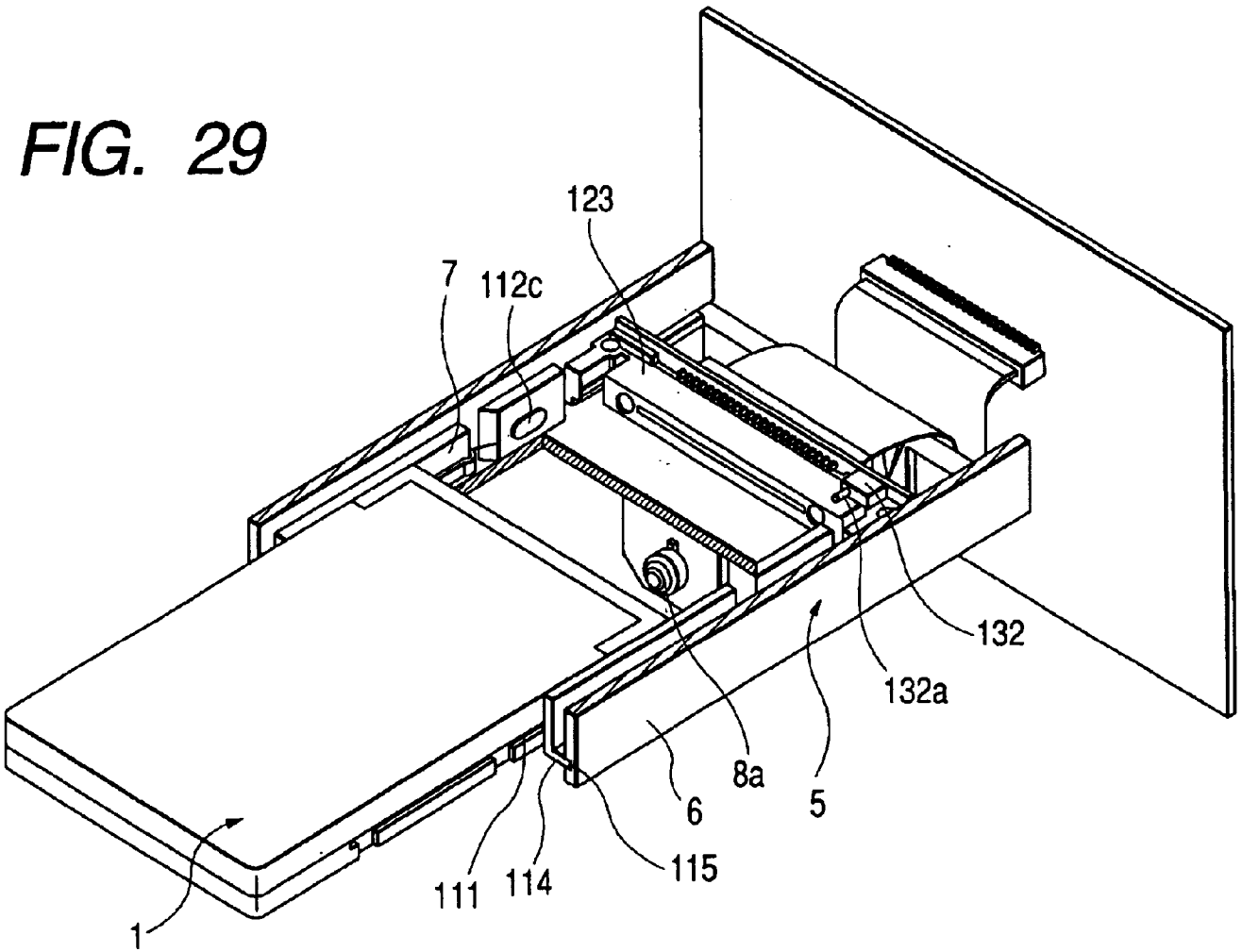
FIG. 29 is a perspective view viewed, obliquely from the above and right, a state where a removable hard disk according to a fourth embodiment is slightly inserted into an auto-loading apparatus.

FIG. 29 is a perspective view viewed, obliquely from the above and right, a state where the removable hard disk 1 is slightly inserted into the auto-loading apparatus 5. The grooves 111 provided on a side face of the removable hard disk 1 are fitted with the projection portions 112*a* and 112*b* provided in the palette 7. At this time, a positional relationship between the palette 7 and the frame 5 remains in the stand-by state, and a detection portion 132*a* of the switch 132 is also in a free state.

Figure 40:
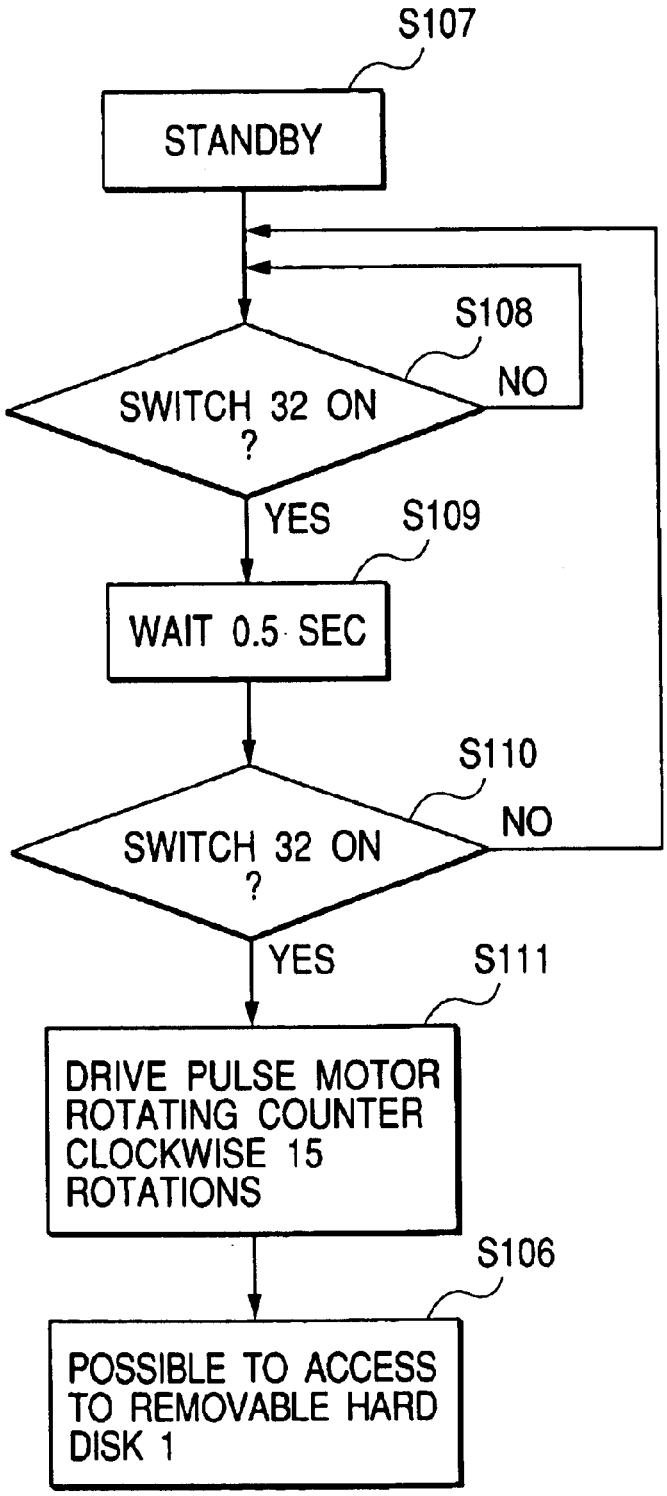
FIG. 40 is a flow chart for explaining an operation of an auto-loading apparatus from a standby state thereof up to a removable hard disk is drawn into the apparatus.
Figure 41:
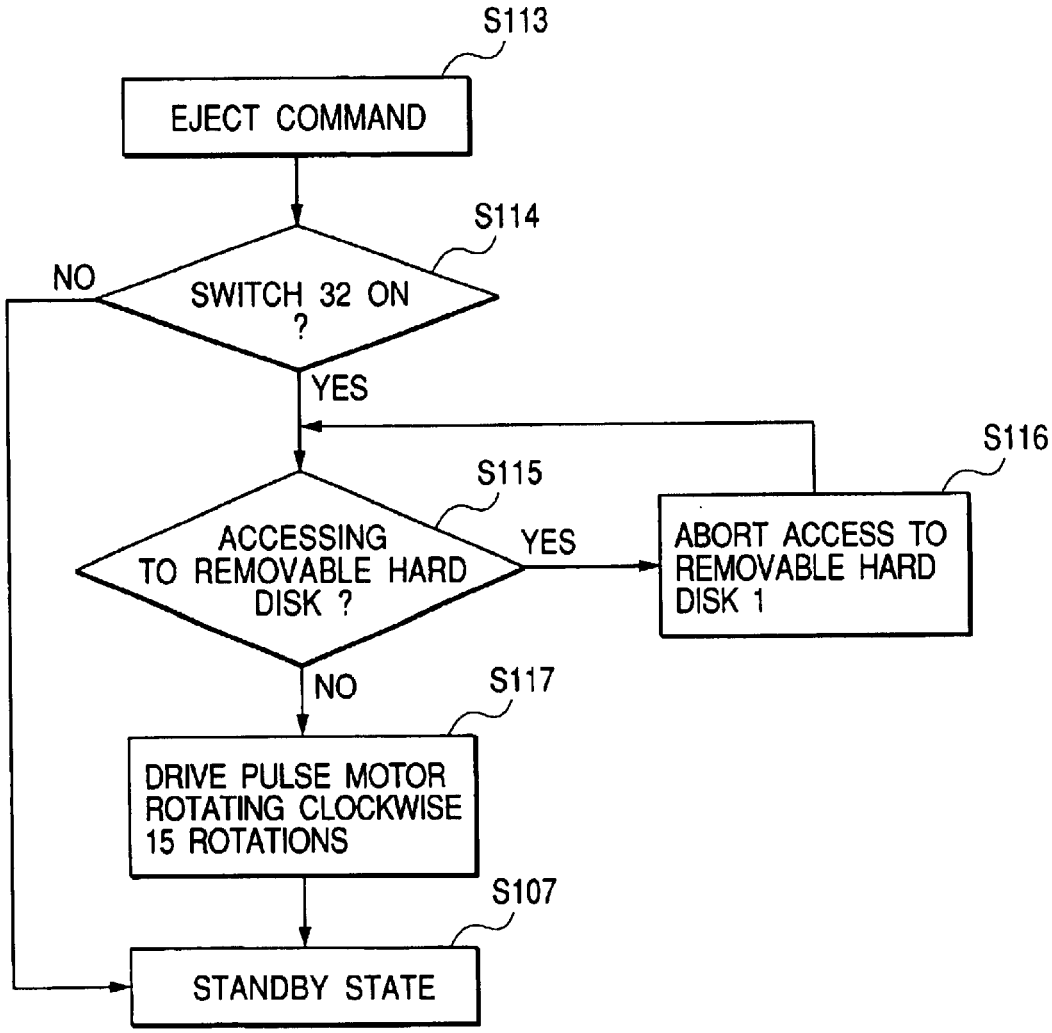
FIG. 41 is a flow chart explaining an ejecting operation of a removable hard disk.

FIGS. 40 and 41 are flow charts for explaining an operation of the auto-loading apparatus 5 from a stand-by state at step 107 up to the removable hard disk 1 is drawn into the apparatus.

At step 108, when the switch turns in an ON state, the process proceeds to step 109 and is brought into stand-by state for 0.5 second. Next, the process proceeds to step 110, and again determines whether the switch 132 is ON or OFF. In the case of OFF, the process is brought into stand-by state at step 107. In the case of ON, the process proceeds to step 111, the pulse motor 8 is driven to rotate counter clockwise 15 rotations, next, the process proceeds to step 106, and it becomes a state possible to access to the removable hard disk 1.

Next, a state described above will be explained in detail with reference to mechanical drawings.

Figure 30:
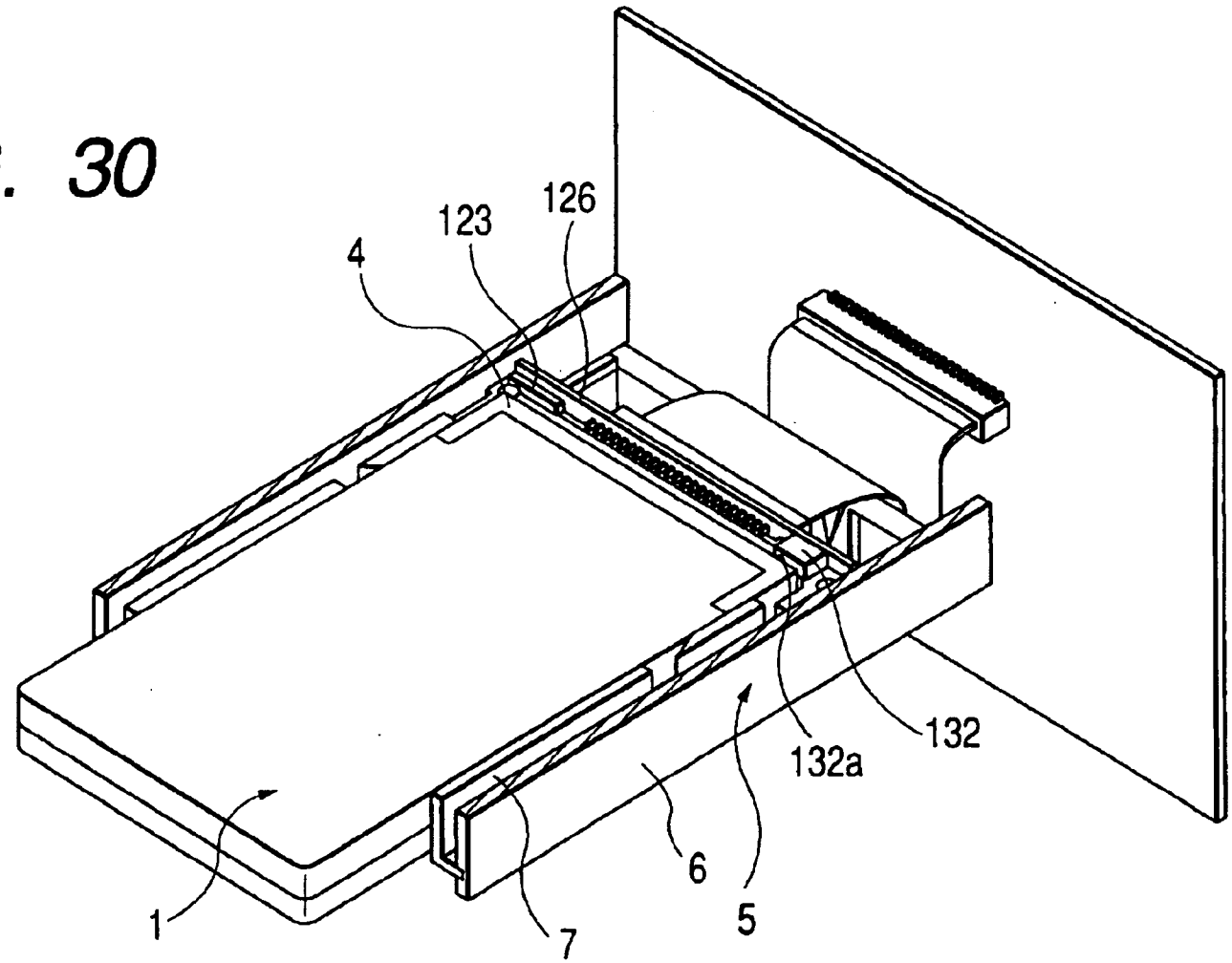
FIG. 30 is a perspective view viewed, obliquely from the above and right, a state where a removable hard disk is inserted into an auto-loading apparatus up to a connector, in a state shown in FIGS. 25 and 26.
Figure 31:
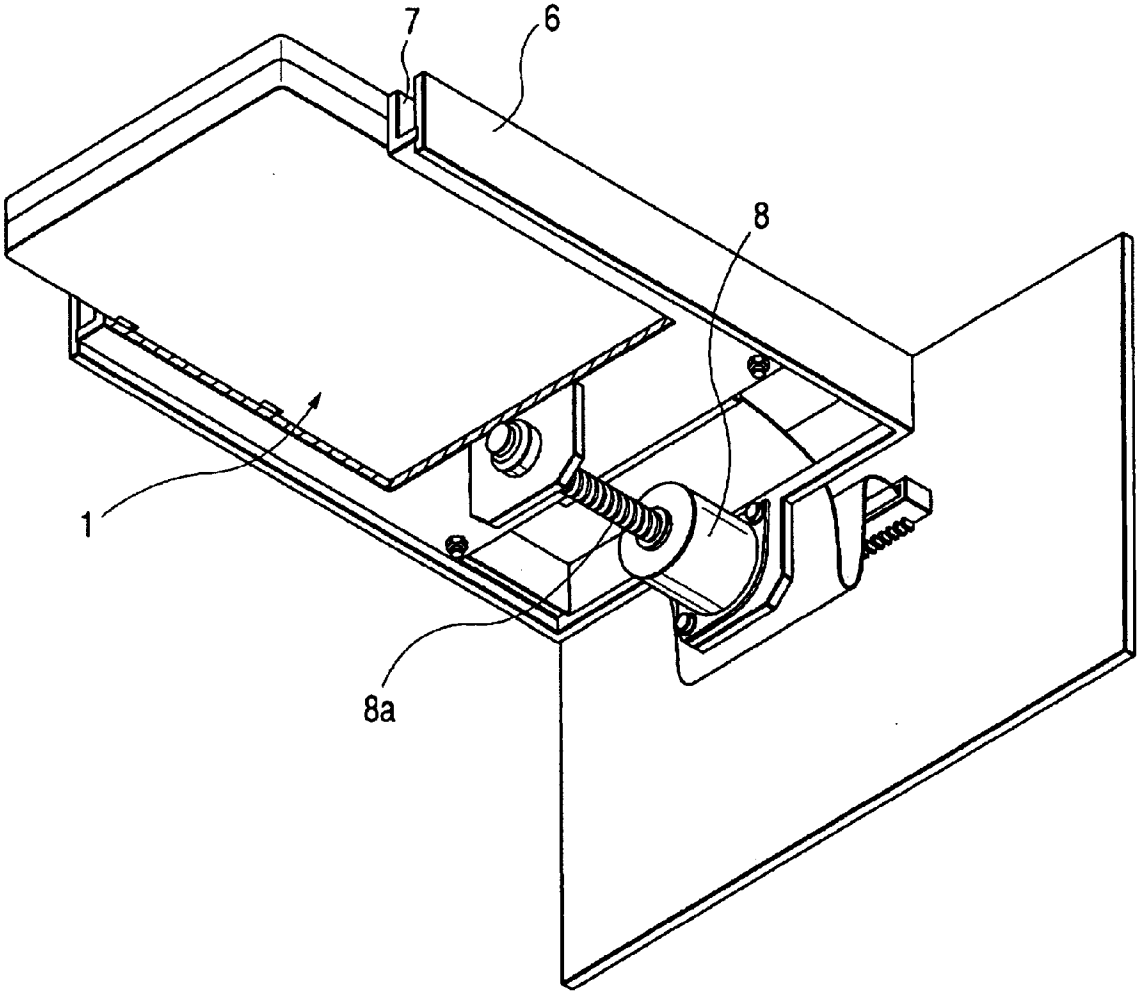
FIG. 31 is a perspective view viewed, obliquely from the below and right, an auto-loading apparatus in a state shown in FIG. 30.
Figure 32:
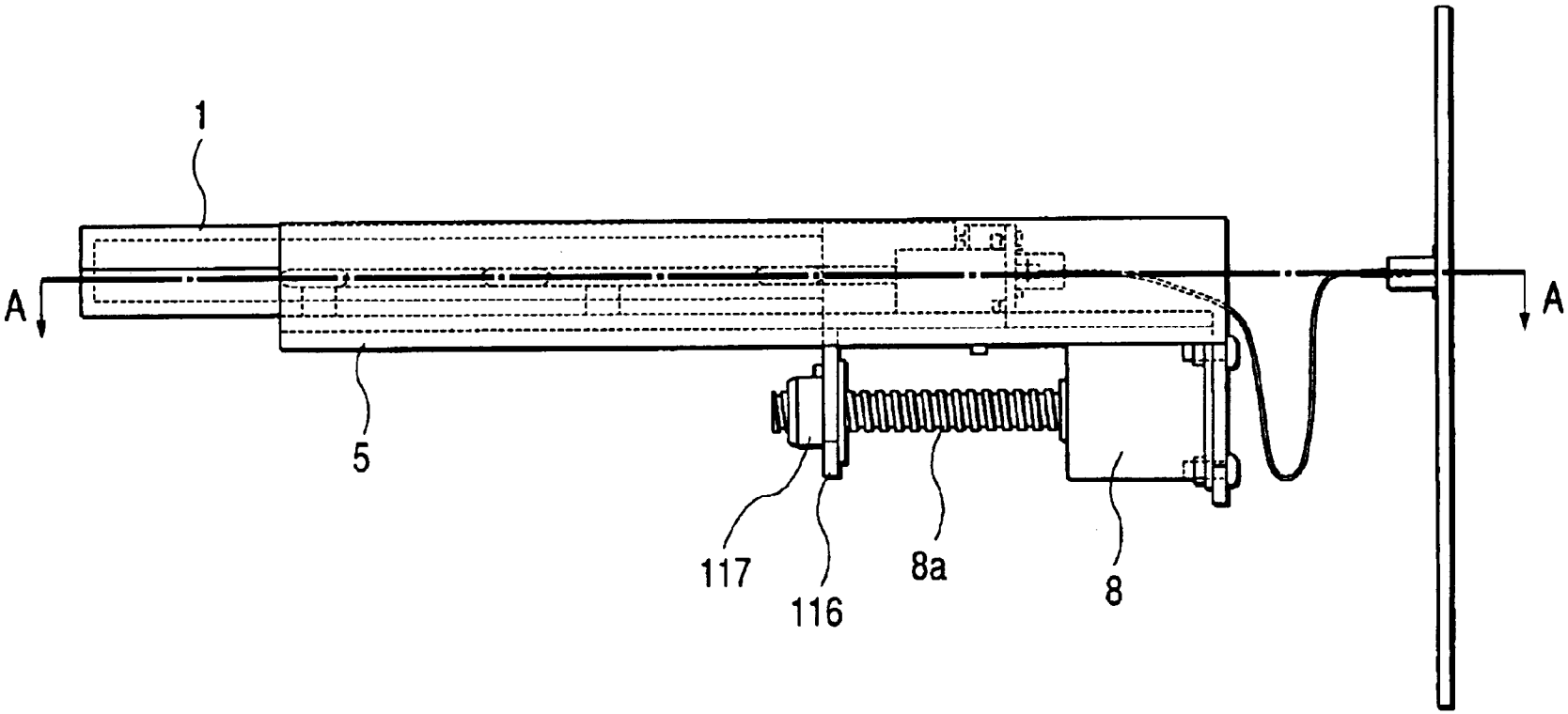
FIG. 32 is a side view viewed, from a right side, an auto-loading apparatus in a state shown in FIG. 30, FIGS. 33A and 33B are sectional views taken on line A—A in FIG. 32.
Figure 33A:
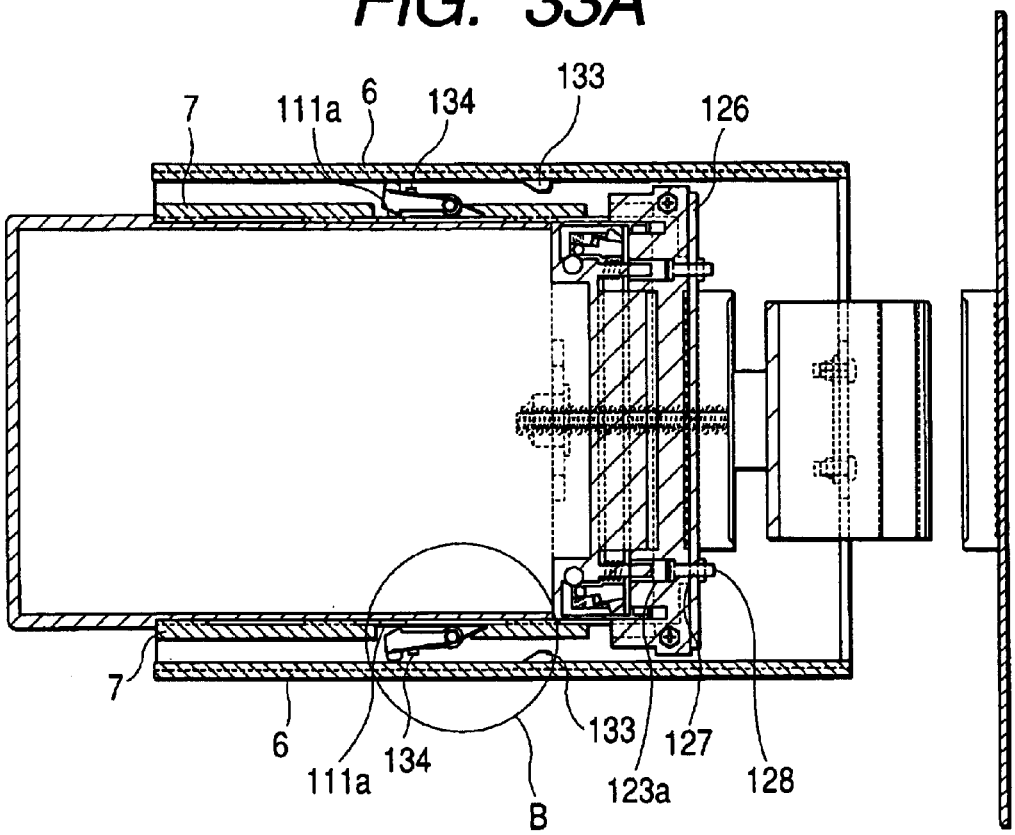
Figure 33B:
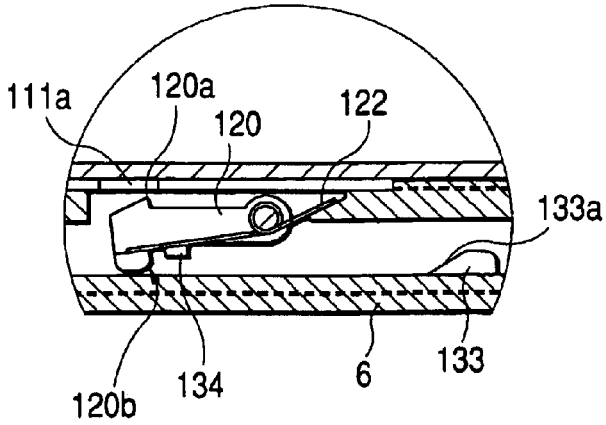

FIGS. 30, 31, 32, 33A and 33B display states where the removable hard disk is inserted into the auto-loading apparatus 5 by a user, and the connector 4 is completely inserted into the connector 123. FIG. 30 is a perspective view viewed, obliquely from the above and right, the state, FIG. 31 is a perspective view viewed, obliquely from the below and right, the state, FIG. 32 is a side view viewed, from right side, the state, FIG. 33A is a sectional view taken on line A—A in FIG. 32, and FIG. 33B is a detailed view in a B portion in FIG. 33A. Meanwhile, in FIG. 33A components in an inner portion of the removable hard disk 1 is omitted.

The connector 4 of the removable hard disk 1 and the connector 123 are completely coupled to each other, at this time, the detection portion 132*a* of the switch 132 is brought into a completely pushed state (ON state). Further, since the pulse motor 8 is not started its rotation in this state, the positional relationship between the frame 6 and the palette 7 remains in a stand-by state (initial state).

Here explained is a detail with regard to a detection of the switch 132.

Length (contact length) from starting electrical coupling of the connector 123 to the connector 4 to completely run into each other, is 5 mm ±0.3 mm in this embodiment. The switch 132 is mounted so that it is turned on after starting the electrical connection between the connector 123 and the connector 4, when they are inserted mutually in an amount of 3 mm. An installation error for each of the connector 123 and the switch 132 is ±0.3 mm. Further, an error of ON timing of a switch is also ±0.3 mm. Accordingly, even in consideration of the worst state, unless the connector 123 is electrically coupled to the connector 4, the switch 32 is never turned ON. In addition, as long as the connector 123 is inserted into the connector 4 until they run into each other, the switch 132 is constituted in a manner to become an ON state positively.

In FIG. 33A, the claws 120 are pushed to both inside directions of the frame 6 by the springs 122, and run into the projection portions 134 provided on the palette 7. Accordingly, in this state, claw tip portions 120*a* are not inserted into the lock grooves 111*a* provided on both sides of the removable hard disk 1. Therefore in this state, the removable hard disk 1 can easily be detached.

Next, when the CPU 135 determines that the switch 132 is turned ON, at 0.5 second after determination, the CPU 135 gives instruction to the pulse motor 8 to drive to rotate counter clockwise 15 rotations viewed from the shaft 8*a* side. Since a pitch of the lead screw shaft 8*a* is 2 mm, when the pulse motor 8 rotates counter clockwise 15 rotations, the palette 7 moves forward to a direction of the pulse motor 8 in an amount of 30 mm and stops. At this time, since the connector 4 and the connector 123 are coupled to each other, the removable hard disk 1 moves forward in an amount of 30 mm to the pulse motor 8 direction together with the palette 7, and the palette is drawn into inside of the auto-loading apparatus 5.

Figure 34:
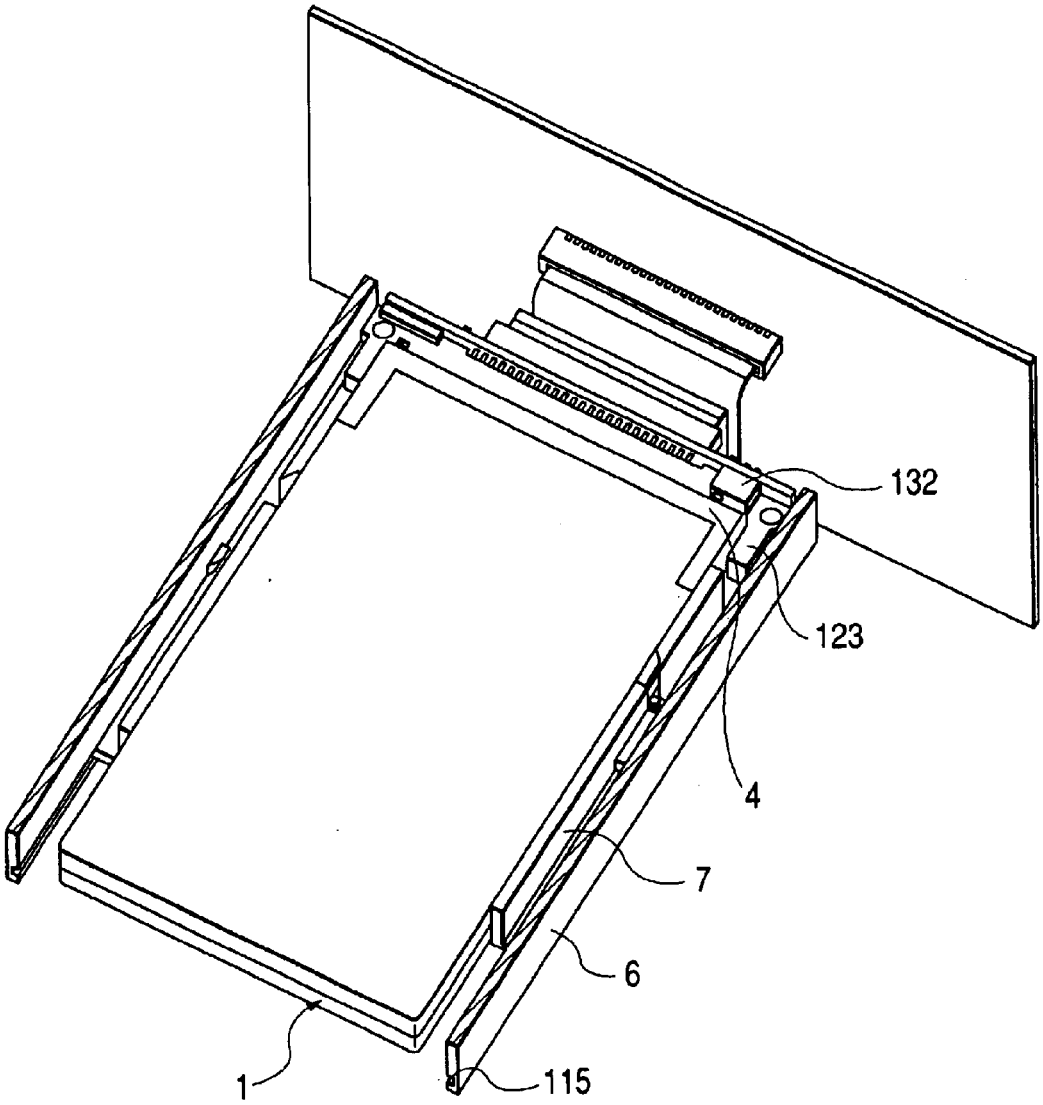
FIG. 34 is a perspective view viewed, obliquely from the above and right, in a state where a removable hard disk is set at inside of an auto-loading apparatus.
Figure 35:
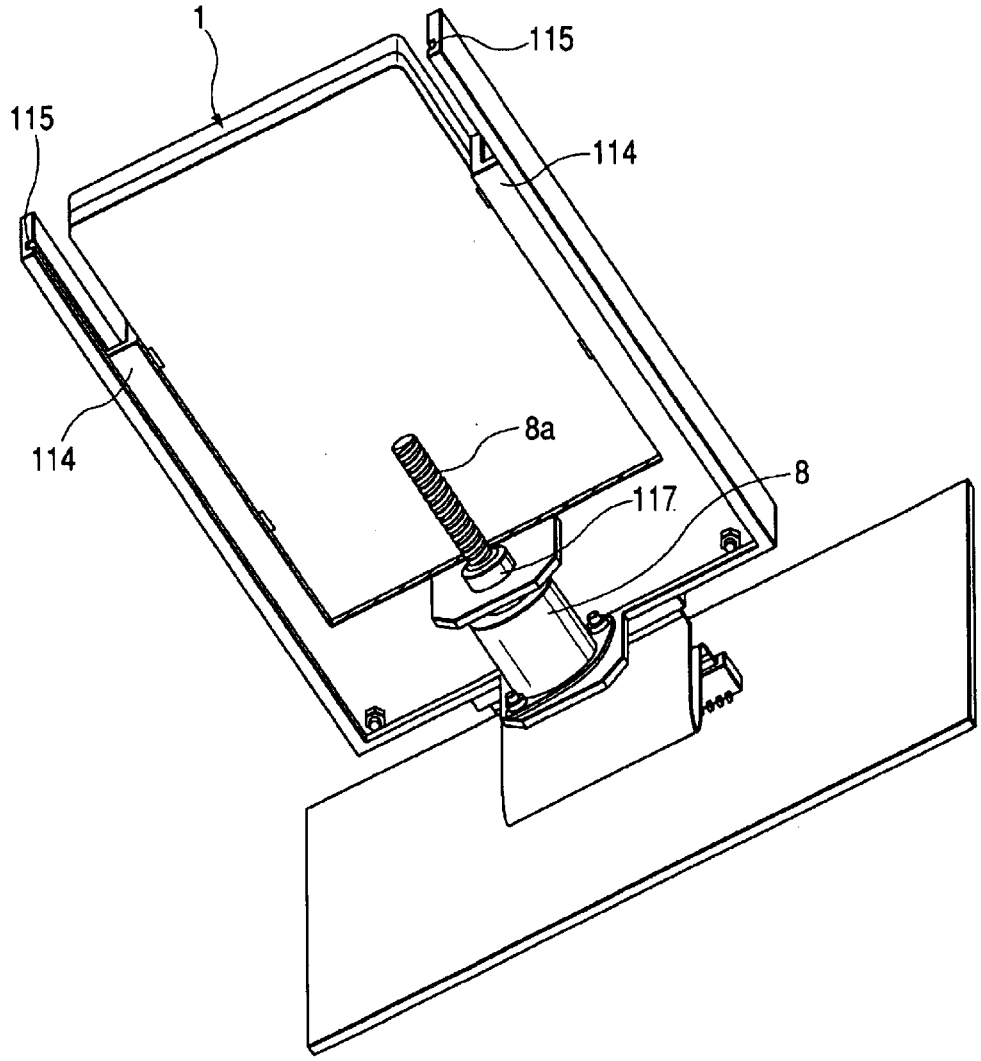
FIG. 35 is a perspective view viewed, obliquely from the below and right, an auto-loading apparatus in a state shown in FIG. 34.
Figure 36:
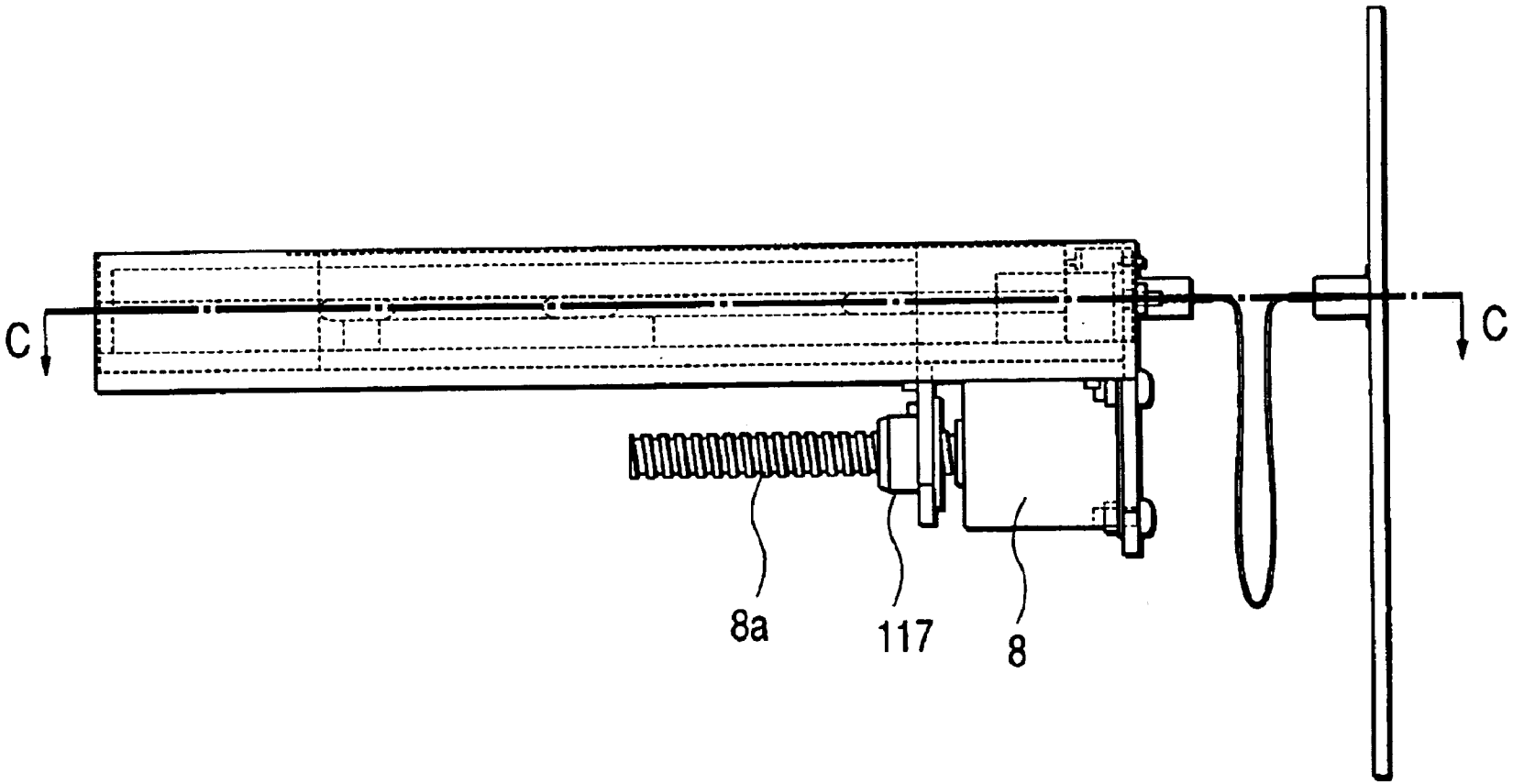
FIG. 36 is a side view, viewed from a right side, an auto-loading apparatus in a state shown in FIG. 34, FIGS. 37A and 37B are sectional views taken on line C—C in FIG. 36.
Figure 37A:
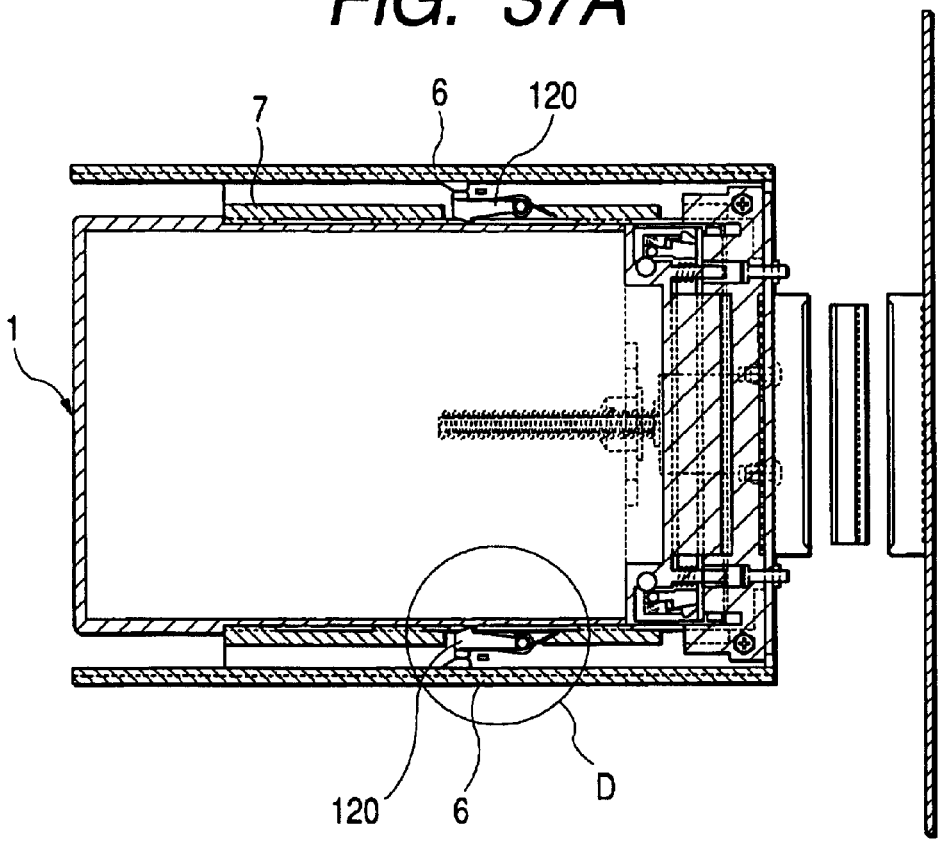
Figure 37B:
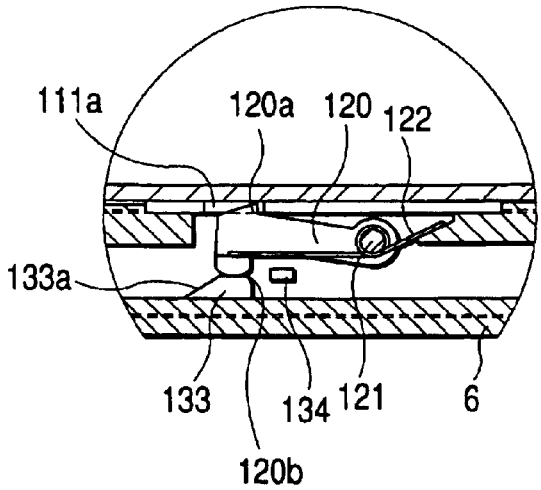

FIGS. 34, 35, 36, 37A, and 37B all display states where the removable hard disk 1 is drawn in an amount of 30 mm into inside of the auto-loading apparatus 5 together with the palette 7. FIG. 34 is a perspective view viewed, obliquely from the above and right, that state, FIG. 35 is a perspective view viewed, from the below and right, the state, FIG. 36 is a side view viewed, from right side, the state, FIG. 37A is a sectional view taken on line C—C in FIG. 36, and FIG. 37B is a detailed view in a D portion in FIG. 37A. Meanwhile, in FIGS. 37A and 37B, inside components of the removable hard disk 1 are omitted similar to those in FIGS. 33A and 33B.

The projection portions 114 of the palette 7 move 30 mm along the grooves 115 by rotating the pulse motor 8 counter clockwise 15 rotations and stops. In this state, as shown in FIG. 37B, since the projection portions 120*b* of the claws 120 run onto the projection portions 133 inside of the frame 6, the claws 120 rotate more inside than that of a stand-by state (initial state), the tip portions 120*a* of the claws 120 are inserted into the lock grooves 111*a*. Accordingly, in this state, the removable hard disk 1 cannot be extracted from the palette 7. Further, the palette 7 is engaged with the lead screw shaft 8*a* by the bearing 117. Consequently, even when force in a extracting direction is applied to the removable hard disk 1 or the palette 7, since the pulse motor 8 does not rotate, the palette 7 cannot move along the grooves 115. As the result, in this state, the removable hard disk 1 is positively fixed, and it becomes possible to access to the removable hard disk 1.

Next explained is an ejecting operation of the removable hard disk 1.

FIG. 41 is a flow chart explaining the ejecting operation of the removable hard disk 1.

At step 113, when an ejection order is given, the process proceeds to step 114 and determines an ON/OFF state of the switch 132. In case of OFF the process is brought into a stand-by state at step 107, in case of ON, the process proceeds to step 115, and it is determined whether the removable hard disk 1 is in an access state. Meanwhile, the ejection order can be given from the PC side by instruction using a keyboard or a mouse, not shown, by a user, or, by pushing an eject button not shown.

A case where it is during an access from the PC side, the process proceeds to step 116 and stops the access, and again, returns at step 115. If not during access, the process proceeds to step 117, and the pulse motor 8 is driven to rotate clockwise 15 rotations. Thereby, the palette 7 moves 30 mm in a direction separated from the pulse motor 8, and the process proceeds to step 107 and is brought into stand-by state.

This state is the state displayed in FIGS. 33A and 33B, therefore, the removable hard disk 1 can be removed from the auto-loading apparatus 5.

Hitherto, as explained in detail, according to the present embodiment, an automatic loading mechanism of the removable hard disk can be realized with simple constitution, therefore, breakage of the hard disk by ejecting during access to the removable hard disk can be prevented, and operability by the user is also improved.

Further, the auto-loading apparatus can be realized with very simple configuration, with reliable locking which can be performed during installation of the removable hard disk, moreover, with positive electric connection, and with considerably improved reliability.

Furthermore, as the apparatus is constituted by a two layer structure of the frame and the palette, and as a lock mechanism is provided on the palette for locking the hard disk reliably, there is increased the certainty during installation.

What is claimed is:

1. Electronic equipment including a container incorporating electronic components, and a connector electrically connected to the electronic components and arranged at an end of the container, said electronic equipment comprising:

a protective portion movable between a first position and a second position in order to protect the connector;

guide portions provided on both sides of said container and said connector for being supported by an information processing unit, lock portions for fixing the protective portion at the first position, wherein the electronic equipment is inserted in the information processing unit, whereby the lock portions are released, and the protective portion is movable between the first position and the second position;

releasing portions provided in said guide portions of said connector for releasing said lock portions, wherein said releasing portions are exposed in aperture portions; and first springs in order to push said protective portion to the first portion, and second springs in order to expose parts of said lock portions in said aperture portions.

2. The electronic equipment as set forth in claim 1, further comprising shafts into which said first springs are inserted for pushing said protective portion to the first position.

3. An information processing unit comprised of electronic equipment incorporating electronic components, and a main body to which the electronic equipment is connected, said electronic equipment comprising:

a first connector arranged at an end of a container electrically connected to the electronic components;

guide portions provided on both sides of said first connector and the container for being supported by said main body;

a protective portion movable between a first position and a second position, in order to protect said first connector; and lock portions for fixing the protective portion at the first position, said main body comprising:

a second connector connectable to said first connector; and guide receiving portions supporting the container, wherein said lock portions are released by supporting said container by said guide receiving portions, and said protective portion becomes movable between the first position and the second position.

4. The information processing unit as set forth in claim 3, further comprising releasing portions for releasing said lock portions, said releasing portions disposed in said guide portions.

5. The information processing unit as set forth in claim 4, wherein said releasing portions are exposed in aperture portions.

6. The information processing unit as set forth in claim 3, further comprising first springs in order to push said protective portion to the first position, and second springs in order to expose parts of said lock portions in said aperture portions.

7. The information processing unit as set forth in claim 6, further comprising shafts into which said first springs are inserted for pushing said protective portion to the first position.

8. The information processing unit as set forth in claim 7, wherein holes in said shafts are provided in said second connector, and said second connector is fixed to said main body by inserting, press fitting, or screwing fastening members into the holes.

9. A connector constructed of a first connector and a second connector which are attachable to and removable from each other, said first connector comprising:

a first connection portion electrically connectable to said second connector;

a protective portion movable between a first position and a second position in order to protect said first connection portion;

guide portions for locking the protective portion at the first position, said guide portions continuously linked to guides provided on both sides of a container which is fixed to said first connector, said second connector comprising:

a second connector portion for connecting to said first connection portion;

a first member for moving the protective portion from the first position to the second position; and a second member for releasing the guide portions.

10. The connector as set forth in claim 9, wherein parts of said guide portions are exposed in aperture portions.

11. An auto-loading apparatus comprising:

electronic equipment including a container incorporating electronic components, and a first connector electrically connected to the electronic components and arranged at an end of the container and attachable to and removable from a main body apparatus;

a second connector for electrically connecting to said first connector;

connection means for electrically connecting said second connector to said electronic components of the main body apparatus;

a first chassis having guide members for guiding said first connector to said second connector;

a second chassis for guiding said first chassis; and moving means for moving said first chassis, wherein said first chassis is movable between a first position where said first connector and said second connector are connected with each other and said electronic equipment is removable from said first chassis, and a second position where said first connector and said second connector are connected with each other and said electronic equipment is not removable from said first chassis.

12. The auto-loading apparatus as set forth in claim 11, wherein when said first chassis resides in said second position, said electronic equipment is locked to said first chassis, and when said first chassis resides in said first position, said electronic equipment is released from being locked to said first chassis.

13. The auto-loading apparatus as set forth in claim 12, wherein said electronic equipment has recessed portions on both sides thereof; when said first chassis resides in said second position, lock members inserted into said recessed portions are provided, and when said first chassis resides in said first position, said lock members are detached from said recessed portions.

14. The auto-loading apparatus as set forth in claim 13, wherein said lock members are rotatably or slidably disposed in said first chassis, and are energized by spring members in directions opposite to said recessed portions.

15. The auto-loading apparatus as set forth in claim 11, wherein said connection means is a flexible cable.

16. The auto-loading apparatus as set forth in claim 11, wherein said moving means is a motor, and a mechanism not to rotate said motor is provided, even when exterior force is applied in a movable direction of said first chassis.

17. The auto-loading apparatus as set forth in claim 11, further comprising:

a protective portion for protecting a connection portion of said first connector;

a lock mechanism for locking said protective portion in an open and closed position; and a releasing mechanism for releasing said lock mechanism.

18. An auto-loading apparatus comprising:

a first chassis for holding removable electronic equipment having a first connector;

a second chassis for holding said first chassis, and said first chassis being movable between a first position and a second position;

a second connector provided in said first chassis, and electrically connected to the first connector of the electronic equipment;

moving means for moving said first chassis between the first position and the second position;

detection means for detecting whether said first connector is connected to said second connector; and first control means for outputting an instruction to said moving means such that said first chassis is moved to either the first position or the second position, based on a detection result of said detection means.

19. The auto-loading apparatus as set forth in claim 18, further comprising lock portions for locking said electronic equipment to said first chassis, at the second position.

20. The auto-loading apparatus as set forth in claim 18, further comprising second control means for moving said chassis to the first position, when power on is detected.

* * * * *

UNITED STATES PATENT AND TRADEMARK OFFICE

CERTIFICATE OF CORRECTION

PATENT NO. : 6,908,342 B2
APPLICATION NO. : 10/254650
DATED : June 21, 2005
INVENTOR(S) : Tsutomu Shimada It is certified that error appears in the above-identified patent and that said Letters Patent is hereby corrected as shown below:

Title page,
Item [56], References Cited, FOREIGN PATENT DOCUMENTS,
"JP 1-91579 6/1988" should read
-- JP 1-91579 6/1989 --.

Column 1,
Lines 24 and 26, "intended" should read -- intending --.

Column 7,
Lines 43 and 61, "portion 53b" should read -- portions 53b --.

Column 8,
Line 66, "lever 61" should read -- levers 61 --.

Column 10,
Line 5, "in inside" should read -- inside --.

Signed and Sealed this

Twenty-seventh Day of June, 2006

JON W. DUDAS
*Director of the United States Patent and Trademark Office*